US009744781B2

(12) United States Patent
Kawai

(10) Patent No.: US 9,744,781 B2
(45) Date of Patent: Aug. 29, 2017

(54) PRINTER, AND METHOD AND COMPUTER-READABLE MEDIUM FOR THE SAME

(71) Applicant: Brother Kogyo Kabushiki Kaisha, Nagoya-shi, Aichi-ken (JP)

(72) Inventor: Junya Kawai, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/279,934

(22) Filed: Sep. 29, 2016

(65) Prior Publication Data

US 2017/0182805 A1 Jun. 29, 2017

(30) Foreign Application Priority Data

Dec. 24, 2015 (JP) ..... 2015-251147

(51) Int. Cl.

| | |
|---|---|
| ***B41J 11/42*** | (2006.01) |
| ***B41J 13/00*** | (2006.01) |
| *B41J 11/70* | (2006.01) |
| *B41J 2/32* | (2006.01) |

(52) U.S. Cl.

CPC ..... *B41J 13/0009* (2013.01); *B41J 11/42* (2013.01); *B41J 2/32* (2013.01); *B41J 11/70* (2013.01)

(58) Field of Classification Search

CPC ..... B41J 13/0009; B41J 11/42; B41J 11/70; B41J 2/32

See application file for complete search history.

(56) References Cited

U.S. PATENT DOCUMENTS

2009/0279136 A1* 11/2009 Kanno ..... G06F 3/121 358/1.15

FOREIGN PATENT DOCUMENTS

JP 2007-038557 A 2/2007

* cited by examiner

*Primary Examiner* — Manish S Shah
*Assistant Examiner* — Yaovi M Ameh
(74) *Attorney, Agent, or Firm* — Banner & Witcoff, Ltd.

(57) ABSTRACT

A printer includes a controller configured to execute a printing process including sequentially printing a plurality of page images on a print medium based on print data while conveying the print medium in a conveyance direction, execute a first interruption process including, when a next cut distance is equal to or less than a printable distance, interrupting the printing process and stopping the print medium such that the next cut position coincides with a cutter position, and cutting the print medium, and execute a second interruption process including, when the next cut distance is more than the printable distance, interrupting the printing process and stopping the print medium such that the next cut position coincides with a position that is located an offset upstream of the cutter position in the conveyance direction.

20 Claims, 15 Drawing Sheets

PRINTER, AND METHOD AND COMPUTER-READABLE MEDIUM FOR THE SAME

CROSS-REFERENCE TO RELATED APPLICATION

This application claims priority under 35 U.S.C. §119 from Japanese Patent Application No. 2015-251147 filed on Dec. 24, 2015. The entire subject matter of the application is incorporated herein by reference.

BACKGROUND

Technical Field

The following description relates to aspects of a printer, a method, and a non-transitory computer-readable storage medium for printing images on a long print medium while conveying the print medium.

Related Art

A printer has been known that is configured to print an image on a long print medium while conveying the print medium in a conveyance direction along a conveyance path. In the printer, if print data for a subsequent sheet is in a printable state when printing of a current sheet has been completed, printing on the subsequent sheet is continuously performed. Meanwhile, if the print data for the subsequent sheet is not in a printable state when printing of the current sheet has been completed, a trailing end of the current sheet is conveyed to a cutting position on the conveyance path, and the current sheet is cut off. Then, a leading end of a continuous sheet is conveyed to a print start position on the conveyance path.

In the known printer, when a plurality of pages are sequentially printed on the print medium being conveyed, the conveyance and the printing of the print medium are interrupted at a particular timing. For instance, when a cut target portion of a printed page reaches the cutting position on the conveyance path, the conveyance and the printing of the print medium are interrupted, and the cut target portion is cut. Thereafter, the conveyance and the printing of the print medium are resumed. Further, for instance, when an amount of print data stored in a print buffer is less than a necessary data amount (i.e., in the case of shortage of print data), the conveyance and the printing of the print medium are interrupted, and the printer is brought into a standby state while receiving and storing print data until the amount of print data stored in the print buffer becomes equal to or more than the necessary data amount. Then, when the amount of print data stored in the print buffer has become equal to or more than the necessary data amount, the conveyance and the printing of the medium are resumed.

SUMMARY

Nonetheless, there may be a case where a next cut target portion of the print medium is close to the cutting position on the conveyance path when the conveyance and the printing of the print medium are interrupted, e.g., due to the shortage of print data. In such a case, shortly after the conveyance and the printing of the medium are resumed in response to the shortage of print data being solved, the next cut target portion reaches the cutting position, and therefore the conveyance and the printing of the print medium are interrupted again. At this time, a conveyance distance of the print medium to be conveyed in a period of time from when the conveyance and the printing of the print medium are resumed to when interrupted again is extremely short. Therefore, the print medium might not be conveyed accurately over an intended distance, e.g., because of step-out of a motor. As a result, in a very short period of time from when the conveyance and the printing of the print medium are resumed to when interrupted again, an image might be printed with a positional displacement and/or a distortion.

Aspects of the present disclosure are advantageous to provide one or more improved techniques, for a printer, which make it possible to properly perform consecutive printing and cutting of a print medium while preventing positional displacement and/or distortion of an image to be printed on the print medium.

According to aspects of the present disclosure, a printer is provided, which includes a conveyor configured to convey a print medium in a conveyance direction along a conveyance path, a print head configured to sequentially print a plurality of page images on the print medium in a first position on the conveyance path, each page image being an image representing a single unit of page, a cutter configured to cut the print medium in a second position on the conveyance path, the second position being downstream of the first position in the conveyance direction, a first storage configured to store a plurality of pieces of print data for printing each individual page image in a manner separated for each print unit, each piece of print data expressing print contents of a single print unit, a second storage configured to store cut target positions of the print medium to be cut by the cutter, and a controller configured to execute a printing process including controlling the print head to sequentially print the plurality of page images on the print medium based on the print data stored in the first storage while controlling the conveyor to convey the print medium, a cut setting process including storing into the second storage a cut target position for each page image printed on the print medium, a first interruption process including, when a first distance is equal to or less than a second distance during the execution of the printing process, interrupting the printing process and stopping the print medium in a state where a next cut position coincides with the second position in the conveyance direction, the next cut position being a cut target position that is located upstream of the second position in the conveyance direction and is closest to the second position among the cut target positions stored in the second storage, the first distance being a distance between the next cut position and the second position in the conveyance direction, the second distance being a distance of a printable range in the conveyance direction, the printable range being a range in which an image is printed with a count of print units corresponding to an amount of the print data stored in the first storage, and controlling the cutter to cut the print medium, a second interruption process including, when the first distance is more than the second distance during the execution of the printing process, interrupting the printing process before a printing operation based on the print data stored in the first storage is completed, and stopping the print medium in a state where the next cut position coincides in the conveyance direction with a particular position that is located a distance equal to or more than a particular distance upstream of the second position, and a resuming process including resuming the printing process after one of the first interruption process and the second interruption process has been executed.

According to aspects of the present disclosure, further provided is a method adapted to be implemented on a processor coupled with a printer including a conveyor configured to convey a print medium in a conveyance direction along a conveyance path, a print head configured to sequentially print a plurality of page images on the print medium in a first position on the conveyance path, each page image being an image representing a single unit of page, a cutter configured to cut the print medium in a second position on the conveyance path, the second position being downstream of the first position in the conveyance direction, a first storage configured to store a plurality of pieces of print data for printing each individual page image in a manner separated for each print unit, each piece of print data expressing print contents of a single print unit, and a second storage configured to store cut target positions of the print medium to be cut by the cutter, the method including a printing process including controlling the print head to sequentially print the plurality of page images on the print medium based on the print data stored in the first storage while controlling the conveyor to convey the print medium, a cut setting process including storing into the second storage a cut target position for each page image printed on the print medium, a first interruption process including, when a first distance is equal to or less than a second distance during the printing process, interrupting the printing process and stopping the print medium in a state where a next cut position coincides with the second position in the conveyance direction, the next cut position being a cut target position that is located upstream of the second position in the conveyance direction and is closest to the second position among the cut target positions stored in the second storage, the first distance being a distance between the next cut position and the second position in the conveyance direction, the second distance being a distance of a printable range in the conveyance direction, the printable range being a range in which an image is printed with a count of print units corresponding to an amount of the print data stored in the first storage, and controlling the cutter to cut the print medium, a second interruption process including, when the first distance is more than the second distance during the printing process, interrupting the printing process before a printing operation based on the print data stored in the first storage is completed, and stopping the print medium in a state where the next cut position coincides in the conveyance direction with a particular position that is located a distance equal to or more than a particular distance upstream of the second position, and a resuming process including resuming the printing process after one of the first interruption process and the second interruption process has been executed.

According to aspects of the present disclosure, further provided is a non-transitory computer-readable medium storing computer-readable instructions that are executable by a processor coupled with a printer including a conveyor configured to convey a print medium in a conveyance direction along a conveyance path, a print head configured to sequentially print a plurality of page images on the print medium in a first position on the conveyance path, each page image being an image representing a single unit of page, a cutter configured to cut the print medium in a second position on the conveyance path, the second position being downstream of the first position in the conveyance direction, a first storage configured to store a plurality of pieces of print data for printing each individual page image in a manner separated for each print unit, each piece of print data expressing print contents of a single print unit, and a second storage configured to store cut target positions of the print medium to be cut by the cutter, the instructions being configured to, when executed by the processor, cause the processor to execute a printing process including controlling the print head to sequentially print the plurality of page images on the print medium based on the print data stored in the first storage while controlling the conveyor to convey the print medium, a cut setting process including storing into the second storage a cut target position for each page image printed on the print medium, a first interruption process including, when a first distance is equal to or less than a second distance during the execution of the printing process, interrupting the printing process and stopping the print medium in a state where a next cut position coincides with the second position in the conveyance direction, the next cut position being a cut target position that is located upstream of the second position in the conveyance direction and is closest to the second position among the cut target positions stored in the second storage, the first distance being a distance between the next cut position and the second position in the conveyance direction, the second distance being a distance of a printable range in the conveyance direction, the printable range being a range in which an image is printed with a count of print units corresponding to an amount of the print data stored in the first storage, and controlling the cutter to cut the print medium, a second interruption process including, when the first distance is more than the second distance during the execution of the printing process, interrupting the printing process before a printing operation based on the print data stored in the first storage is completed, and stopping the print medium in a state where the next cut position coincides in the conveyance direction with a particular position that is located a distance equal to or more than a particular distance upstream of the second position, and a resuming process including resuming the printing process after one of the first interruption process and the second interruption process has been executed.

BRIEF DESCRIPTION OF THE ACCOMPANYING DRAWINGS

FIGS. 10A, 10B, 10C, 10D, and 10E are illustrations showing a flow of a printed matter producing process in the illustrative embodiment according to one or more aspects of the present disclosure.

Figure 11A:
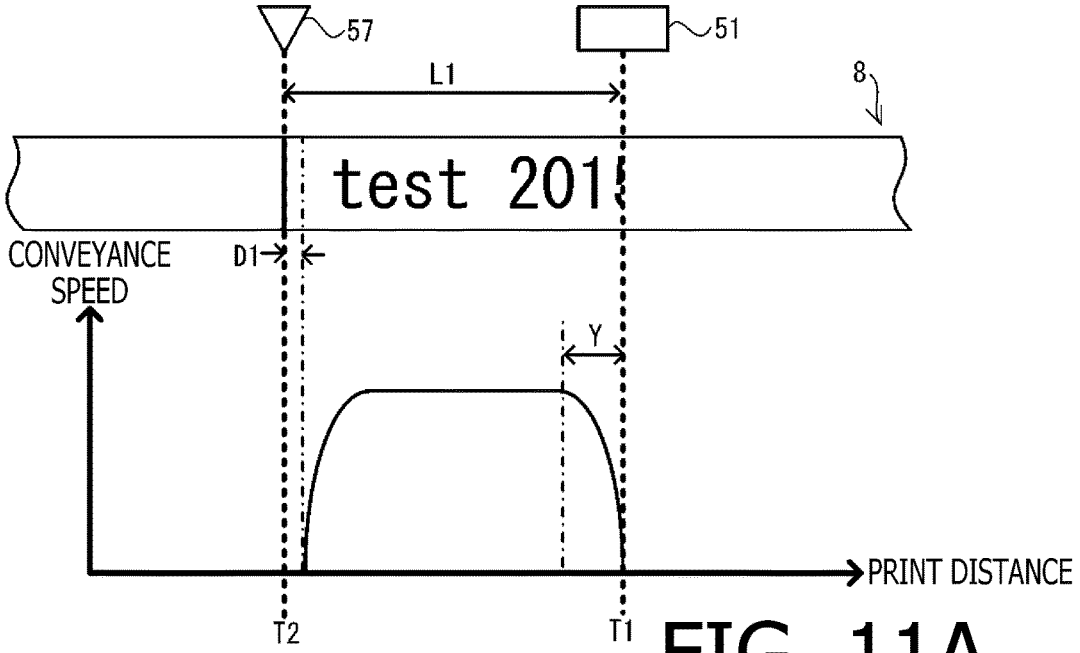
Figure 11B:
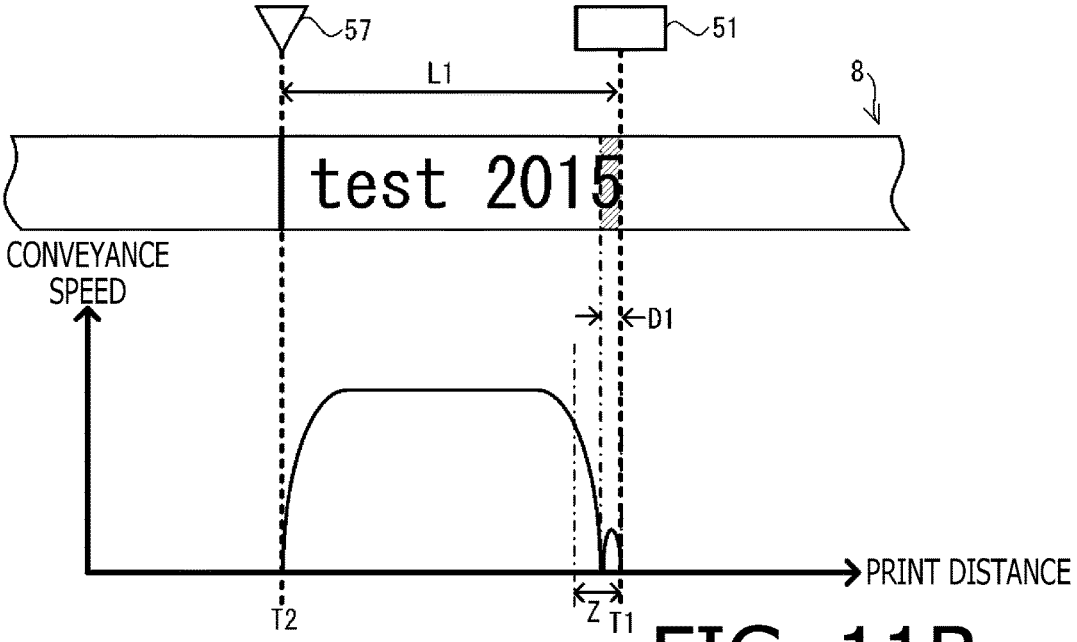

FIGS. 11A and 11B are illustrations showing a flow of a printed matter producing process in a comparative example.

Figure 12:
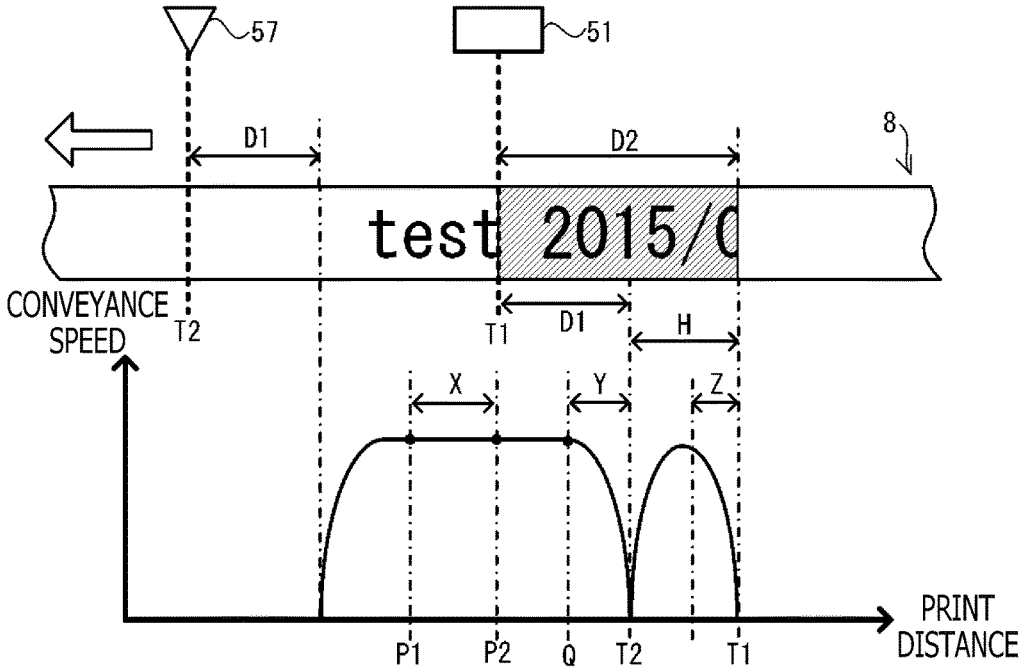

FIG. 12 is an illustration showing a flow of the printed matter producing process in the illustrative embodiment according to one or more aspects of the present disclosure.

Figure 13:
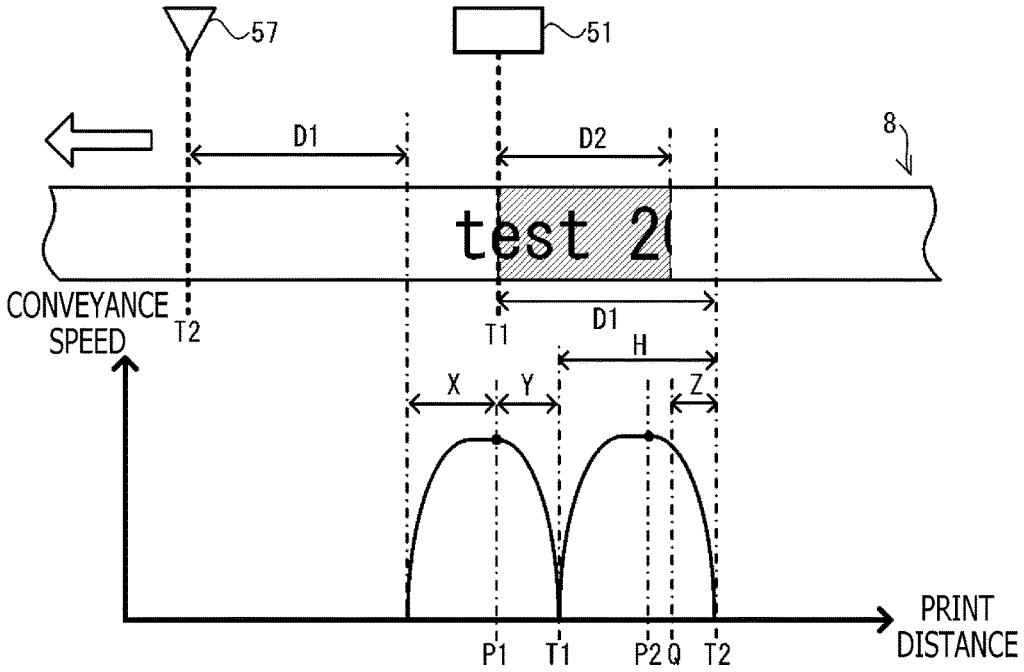

FIG. 13 is an illustration showing a flow of the printed matter producing process in the illustrative embodiment according to one or more aspects of the present disclosure.

Figure 14:
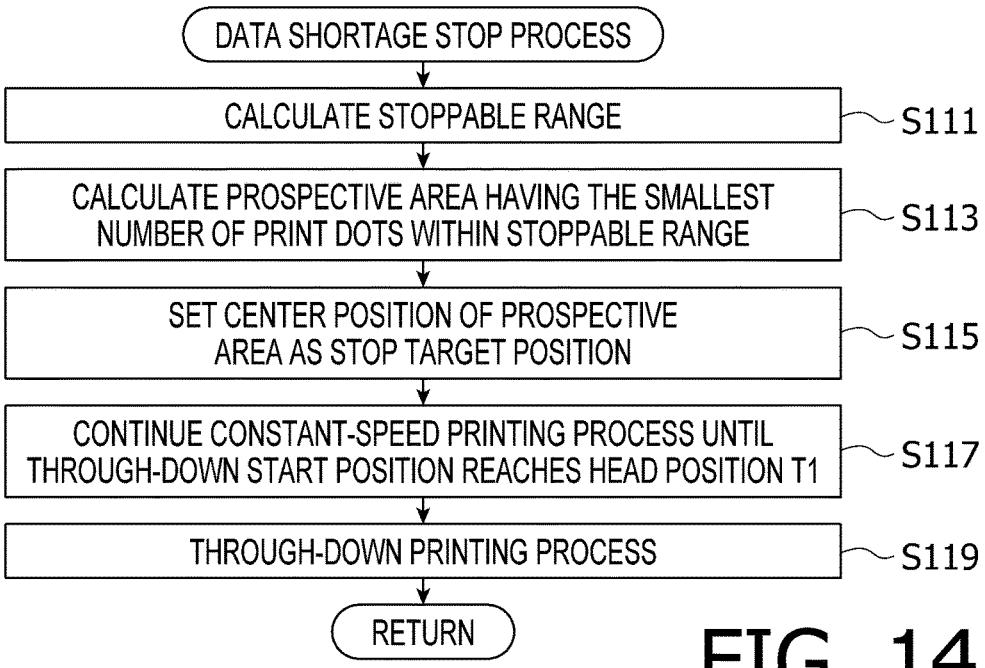

FIG. 14 is a flowchart showing a procedure of a data shortage stop process in a first modification according to one or more aspects of the present disclosure.

Figure 15:
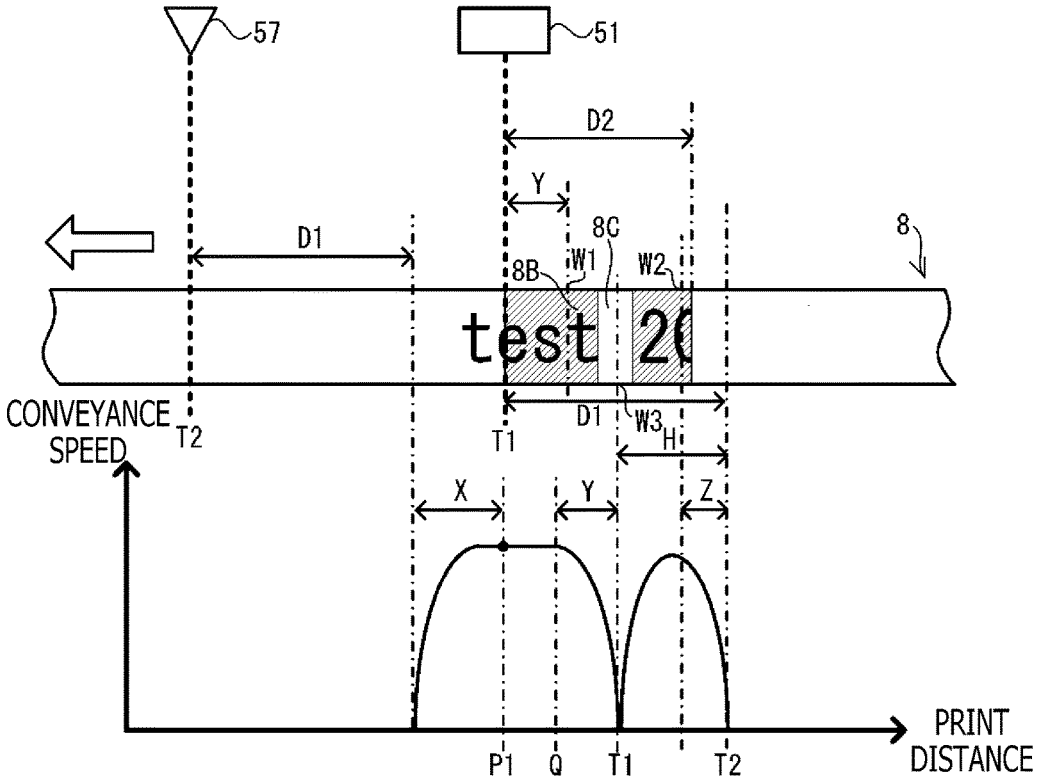

FIG. 15 is an illustration showing a flow of a printed matter producing process in the first modification according to one or more aspects of the present disclosure.

Figure 16:
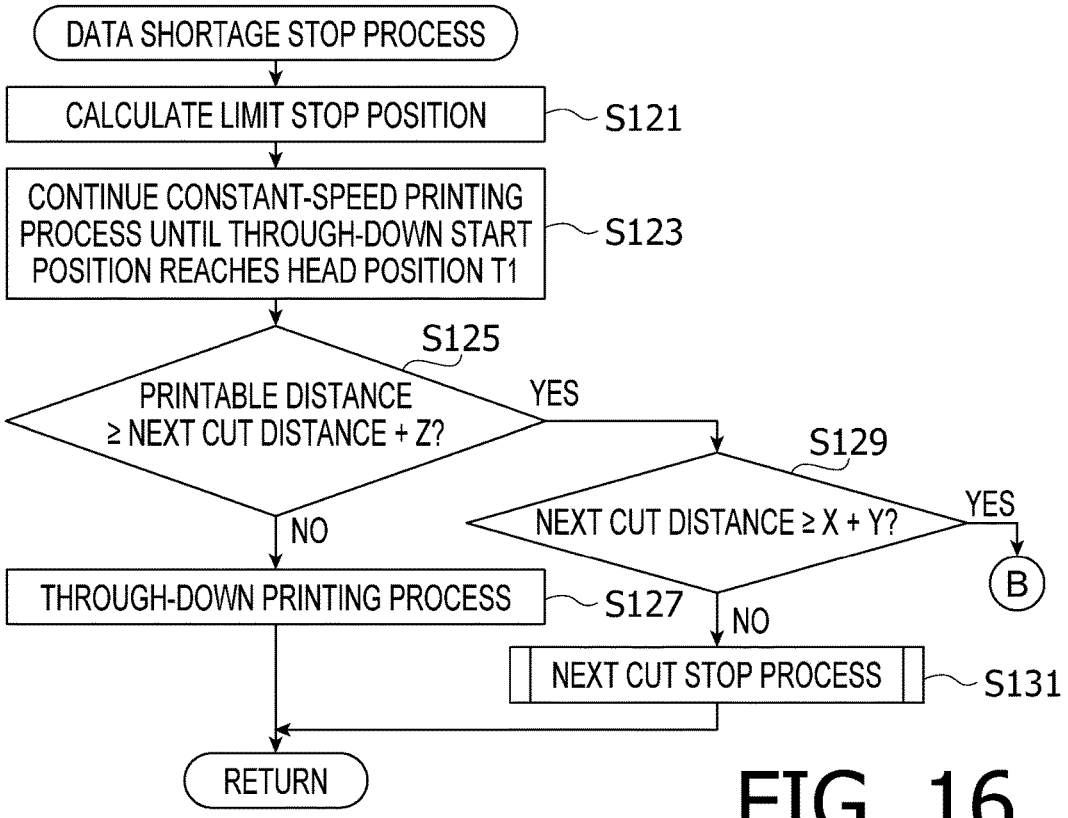

FIG. 16 is a flowchart showing a procedure of a data shortage stop process in a second modification according to one or more aspects of the present disclosure.

Figure 17:
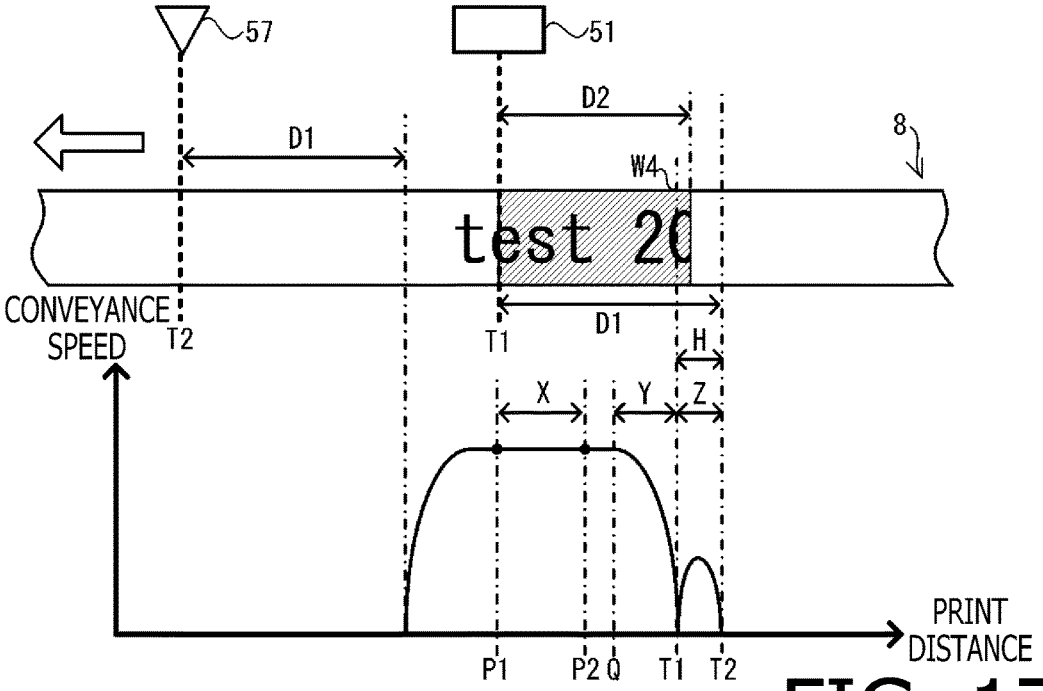

FIG. 17 is an illustration showing a flow of a printed matter producing process in the second modification according to one or more aspects of the present disclosure.

Figure 18:
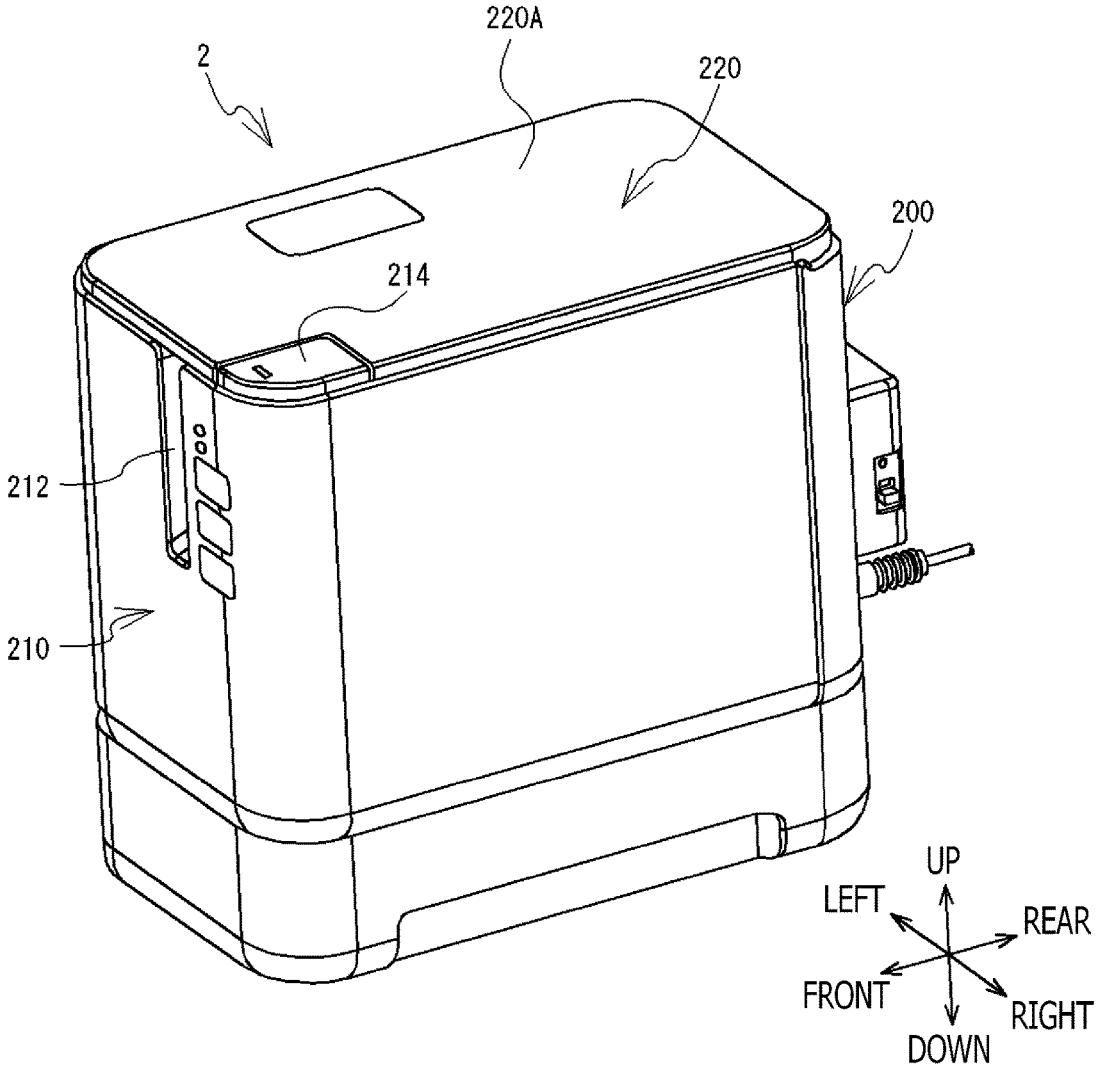

FIG. 18 is a perspective view showing a printer in a further modification according to one or more aspects of the present disclosure.

Figure 19:
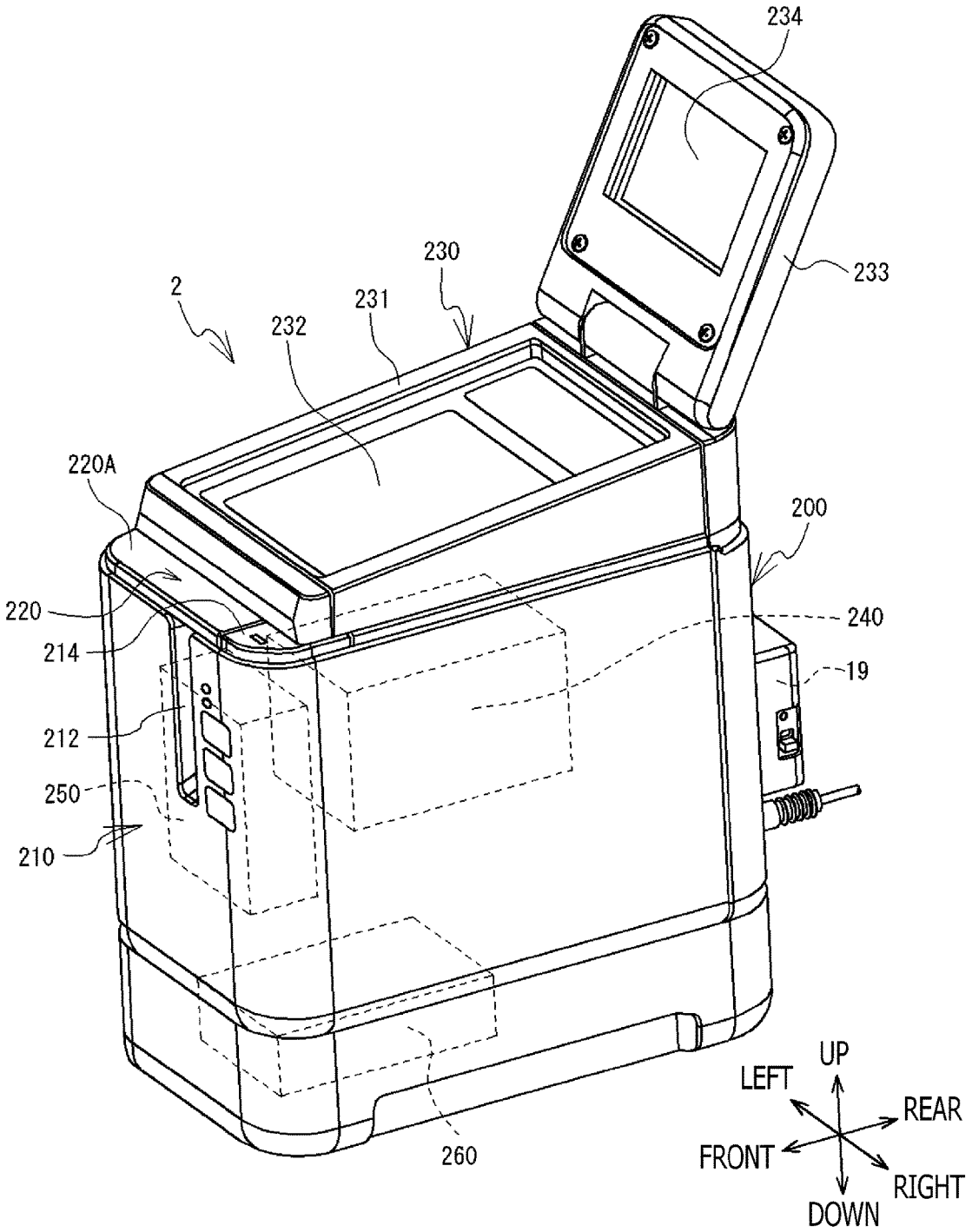

FIG. 19 is a perspective view showing the printer in a state where an interface unit is attached to an upper surface of a cover of the printer, in the further modification according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an illustrative embodiment according to aspects of the present disclosure will be described with reference to the accompanying drawings. In the following description, an upside, a downside, a left side, a right side, a front side, and a rear side of a printer 1 of the illustrative embodiment will be defined as shown in FIG. 1.

Figure 1:
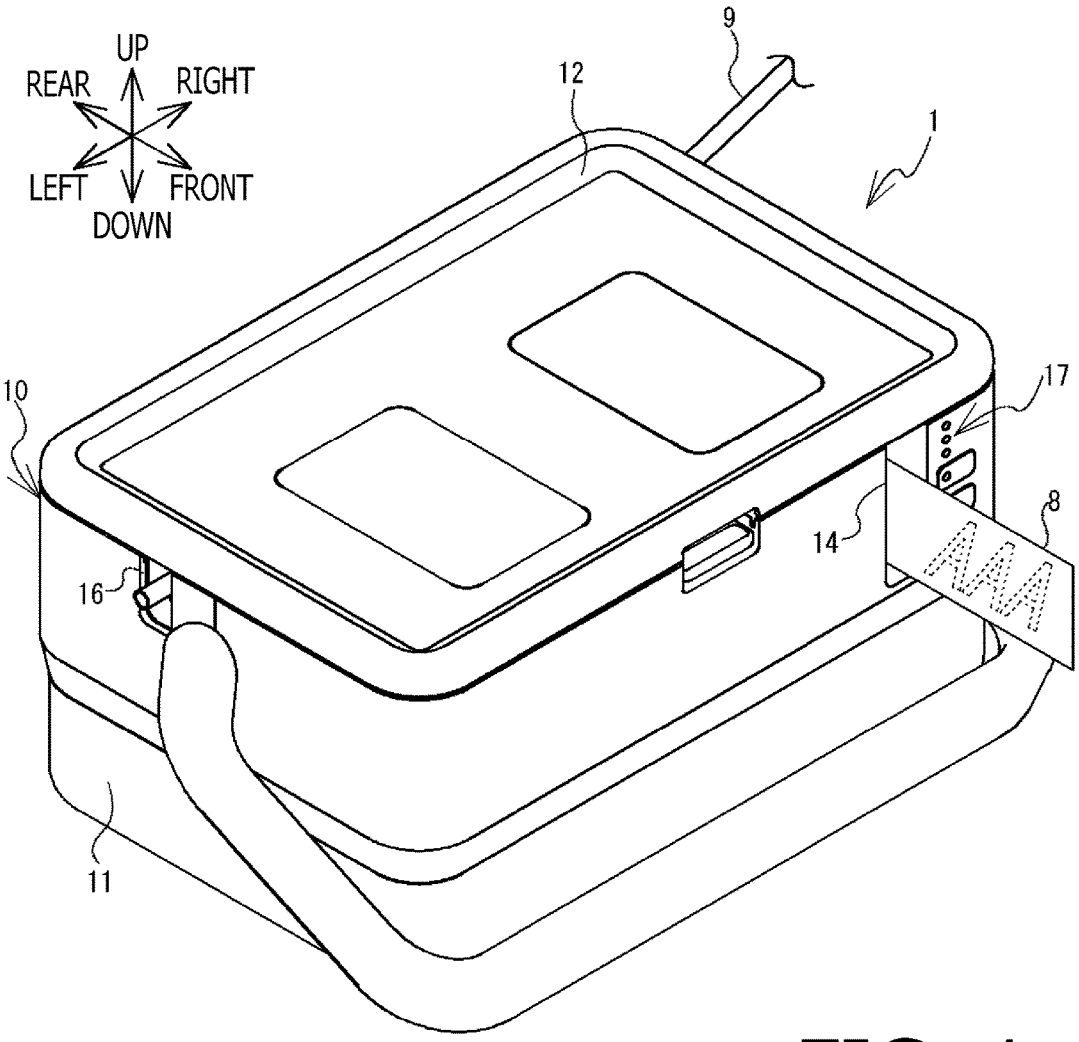
FIG. 1 is a perspective view showing a printer when viewed from an upper front left side, in an illustrative embodiment according to one or more aspects of the present disclosure.

As shown in FIG. 1, the printer 1 includes two printing mechanisms, and is configured to perform printing on a tape 8 and a tube 9 with the two printing mechanisms, respectively. The tape 8 is a strip-shaped print medium. The tube 9 is a tubular print medium. The printer 1 includes a housing 10. The housing 10 includes a main body casing 11 and a cover 12. The main body casing 11 is formed in the shape of a rectangular parallelepiped box having a longitudinal direction along a left-to-right direction. The cover 12 is a plate-shaped member disposed above the main body casing 11. A rear end portion of the cover 12 is rotatably supported by an upper rear end portion of the main body casing 11. When the cover 12 is closed relative to the main body casing 11 (see FIG. 1), the cover 12 covers an attachment surface 11A (see FIG. 2). When the cover 12 is open relative to the main body casing 11, the attachment surface 11A is exposed upward (see FIG. 2).

At side surfaces of the housing 10, a tape outlet 14, a tube inlet 15, a tube outlet 16, and a user interface 17 are disposed. The tape outlet 14 is disposed at a front surface of the housing 10. The tape outlet 14 is an opening for discharging the tape 8 out of the housing 10 therethrough. The tube inlet 15 is disposed at a right surface of the housing 10. The tube inlet 15 is an opening for introducing the tube 9 into the housing 10 therethrough. The tube outlet 16 is disposed at a left surface of the housing 10. The tube outlet 16 is an opening for discharging the tube 9 out of the housing 10 therethrough. The user interface 17 includes a display and operable members. The display includes a plurality of LEDs configured to show an operating condition of the printer 1. The operable members include a plurality of operable buttons such as a power button and a start button.

Figure 2:
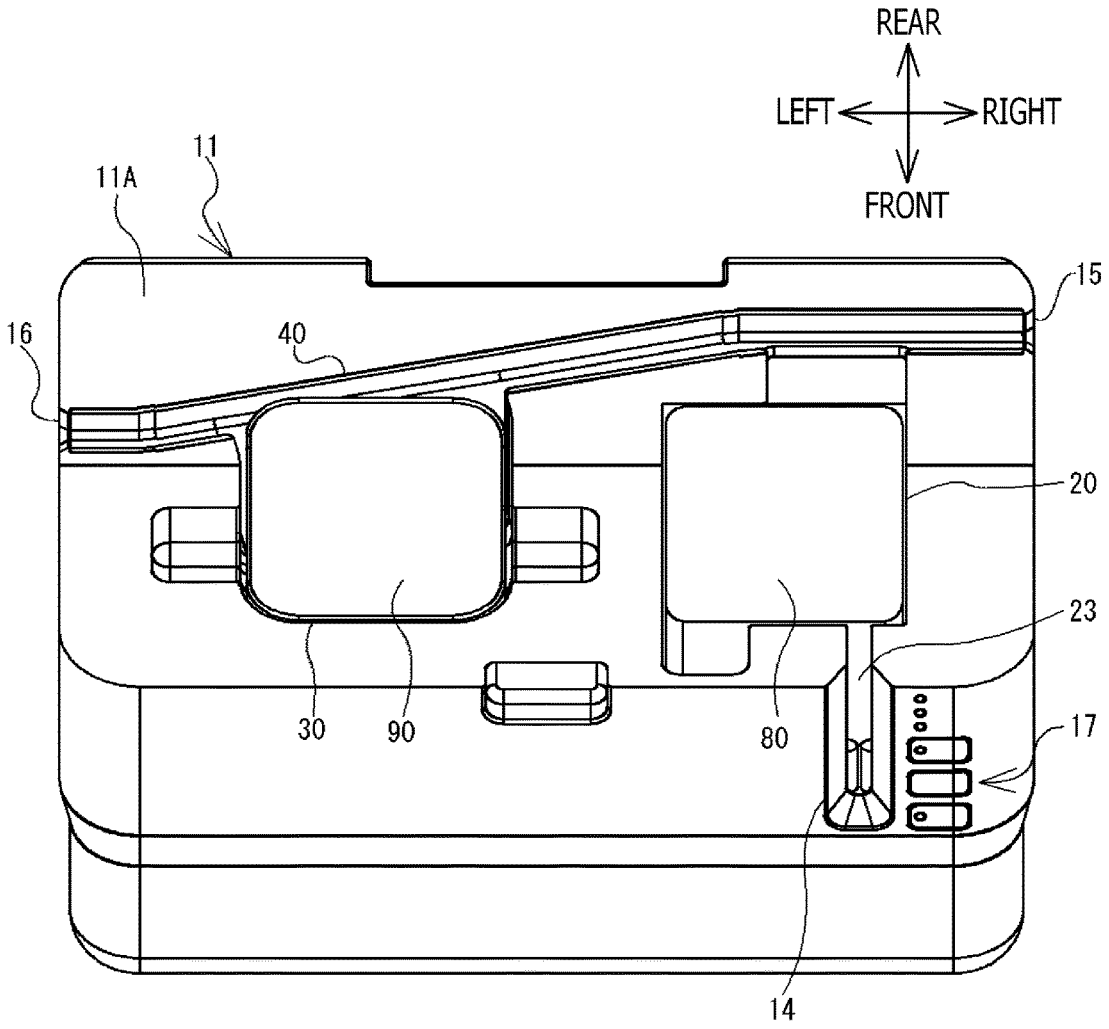
FIG. 2 is a perspective view showing a main body casing of the printer when viewed from an upper front side, in the illustrative embodiment according to one or more aspects of the present disclosure.

As shown in FIG. 2, at the attachment surface 11A, a tape attachment section 20, a ribbon attachment section 30, and a tube attachment section 40 are disposed. The tape attachment section 20 is a recessed section having an open upper side. The tape attachment section 20 is configured such that a tape cassette 80 is detachably attached thereto. In the illustrative embodiment, the tape attachment section 20 is positioned at a right portion of the attachment surface 11A. When the cover 12 is open (see FIG. 1), a user is allowed to detachably attach the tape cassette 80 to the tape attachment section 20 from above. A conveyance guide 23 is a groove that extends frontward continuously from a front right portion of the tape attachment section 20. A front end portion of the conveyance guide 23 is connected with the tape outlet 14.

The ribbon attachment section 30 is a recessed section having an open upper side. The ribbon attachment section 30 is configured such that a ribbon cassette 90 is detachably attached thereto. In the illustrative embodiment, the ribbon attachment section 30 is positioned at a left portion of the attachment surface 11A. When the cover 12 is open, the user is allowed to detachably attach the ribbon cassette 90 to the ribbon attachment section 30 from above. The tube attachment section 40 is configured such that the tube 9 (see FIG. 1) is detachably attached thereto.

The tube attachment section 40 is an upward-open groove extending from the tube inlet 15 to the tube outlet 16. In the illustrative embodiment, the tube attachment section 40 passes behind the tape attachment section 20 and the ribbon attachment section 30. Further, the tube attachment section 40 communicates with a rear end portion of the ribbon attachment section 30. When the cover 12 is open, the user is allowed to detachably attach the tube 9 to the tube attachment section 40 from above. The tube 9 is attached to the tube attachment section 40, so as to extend from the tube inlet 15 to the tube outlet 16.

Figure 3:
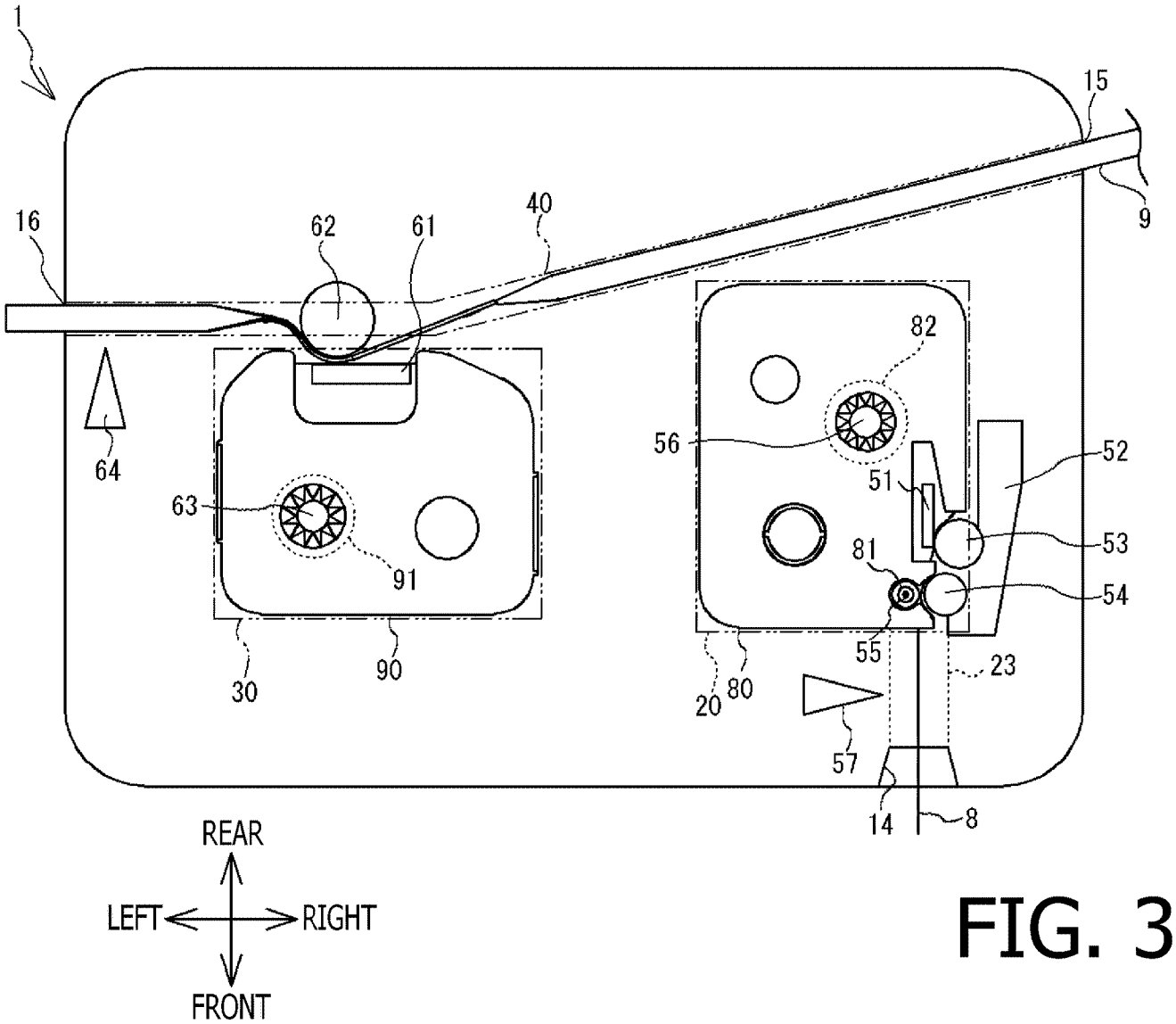
FIG. 3 is a plain view schematically showing an internal configuration of the printer in the illustrative embodiment according to one or more aspects of the present disclosure.

As shown in FIG. 3, the tape cassette 80 is formed in a box shape and configured to accommodate the unused tape 8, an unused ink ribbon (not shown), a tape driving roller 81, and a ribbon winding spool 82. The tape driving roller 81 is configured to pull the tape 8 out of the tape cassette 80. The ribbon winding spool 82 is configured to wind the ink ribbon in the tape cassette 80.

The tape attachment section 20 includes a print head 51, a tape driving shaft 55, and a ribbon winding shaft 56. The print head 51 is a thermal head configured to perform a line-by-line printing operation using a plurality of printing elements arranged in a direction perpendicular to a conveyance direction of the tape 8. The tape driving shaft 55 is configured to rotate the tape driving roller 81. The ribbon winding shaft 56 is configured to rotate the ribbon winding spool 82. On the right of the tape attachment section 20, a platen holder 52 is disposed. The platen holder 52 is configured to rotatably support a platen roller 53 and a movable conveyance roller 54. The platen roller 53 is opposed to the print head 51 and rotatable relative to the print head 51. The movable conveyance roller 54 is opposed to the tape driving shaft 55 and rotatable relative to the tape driving shaft 55.

When the cover 12 (see FIG. 1) is opened, the platen holder 52 moves to a retreat position such that the platen roller 53 and the movable conveyance roller 54 are placed outside the tape attachment section 20. When the user attaches the tape cassette 80 to the tape attachment section 20, the tape driving shaft 55 and the ribbon winding shaft 56 are inserted into the tape driving roller 81 and the ribbon winding spool 82, respectively.

Subsequently, when the cover 12 is closed, the platen holder 52 moves to an operating position such that the platen roller 53 and the movable conveyance roller 54 are placed inside the tape attachment section 20. At this time, the platen roller 53 urges, toward the print head 51, the tape 8 and the ink ribbon of the tape cassette 80 in an overlapped manner. The movable conveyance roller 54 pinches the tape 8 and the ink ribbon of the tape cassette 80 with the tape driving roller 81. Thereby, the printer 1 is placed in a printable state where the printer 1 is allowed to perform printing on the tape 8 of the tape cassette 80.

Behind the tape outlet 14 (i.e., on a rear side of the tape outlet 14), a cutter 57 is disposed. The cutter 57 is configured to cut the tape 8 laid in the conveyance guide 23 in a thickness direction of the tape 8. More specifically, the cutter 57 is capable of half cutting to cut a part (e.g., only a release paper) of layers of the tape 8 thereby forming a slit, and is capable of full cutting to cut off all (e.g., the release paper and a mount) of the layers of the tape 8.

The ribbon cassette 90 is formed in a box shape and configured to accommodate an unused ink ribbon and a ribbon winding spool 91. The ribbon attachment section 30 includes a print head 61, a movable conveyance roller 62, and a ribbon winding shaft 63. The print head 61 is a thermal head configured to perform a line-by-line printing operation by a plurality of printing elements (i.e., a plurality of dots) arranged in a direction perpendicular to a conveyance direction of the tube 9. The movable conveyance roller 62 is opposed to the print head 61 and rotatable relative to the print head 61. The ribbon winding shaft 63 is configured to rotate the ribbon winding spool 91.

When the cover 12 (see FIG. 1) is opened, the movable conveyance roller 62 is placed behind the tube attachment section 40 and separated away from the print head 61. When the user attaches the ribbon cassette 90 to the ribbon attachment section 30, the ribbon winding shaft 63 is inserted into the ribbon winding spool 91. The user attaches the tube 9 to the tube attachment section 40. Subsequently, when the cover 12 is closed, the movable conveyance roller 62 is placed inside the tube attachment section 40 and positioned close to the print head 61. At this time, the movable conveyance roller 62 urges, toward the print head 61, the tube 9 attached to the tube attachment section 40 and the ink ribbon of the ribbon cassette 90 in an overlapped manner. Thereby, the printer 1 is placed into a state where the printer 1 is allowed to perform printing on the tube 9 with the ribbon cassette 90.

On the right of the tube outlet 16, a cutter 64 is disposed. The cutter 64 is configured to cut the tube 9 attached to the tube attachment section 40 in a radial direction of the tube 9. The cutter 64 is capable of half cutting to cut a part of the tube 9 in the radial direction thereby forming a slit, and is capable of full cutting to completely cut off the tube 9 in the radial direction.

Figure 4:
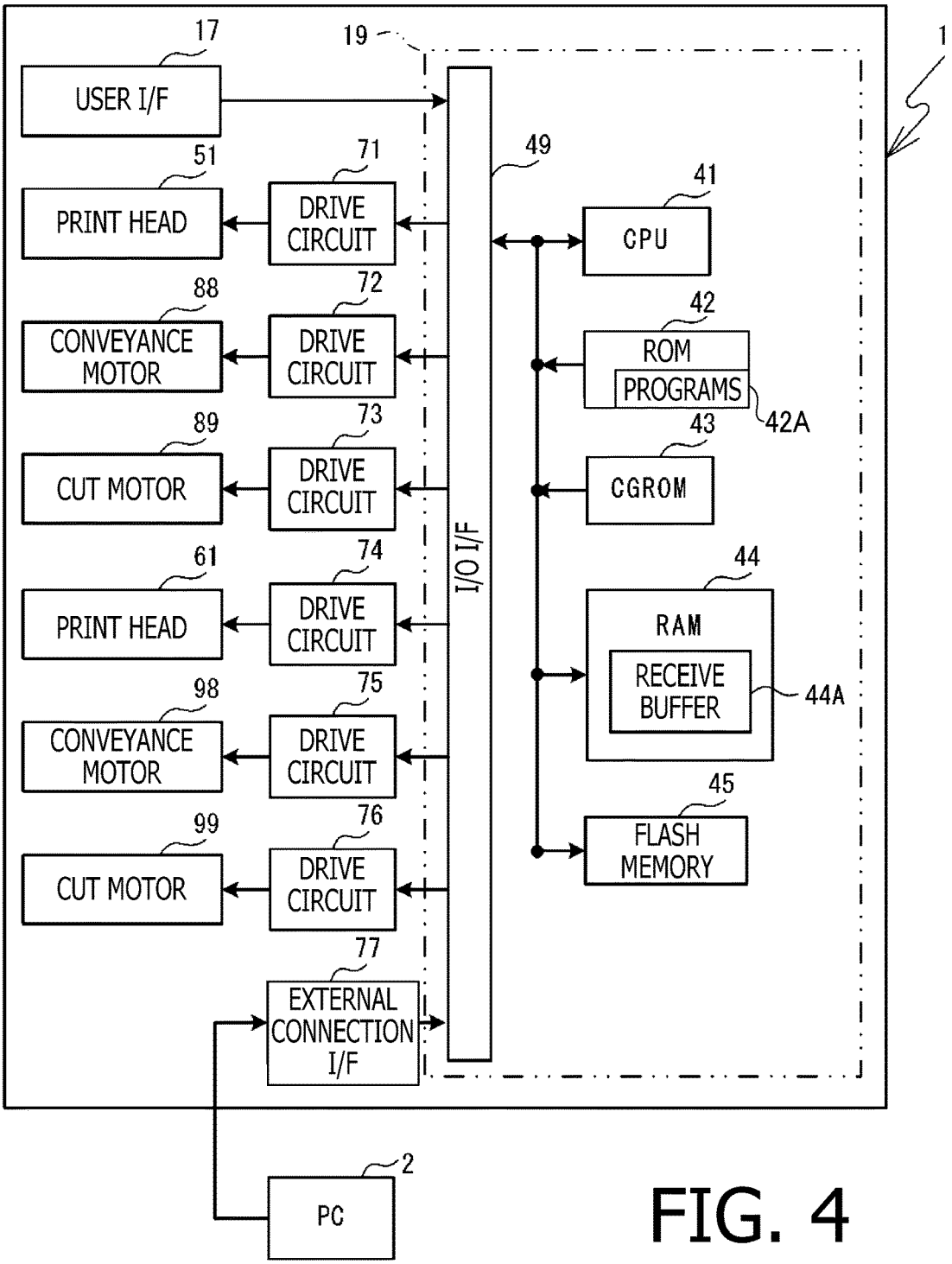
FIG. 4 is a block diagram showing an electrical configuration of the printer in the illustrative embodiment according to one or more aspects of the present disclosure.

Referring to FIG. 4, an electrical configuration of the printer 1 will be described. The printer 1 includes a control board 19. The control board 19 includes a CPU 41, a ROM 42, a CGROM 43, a RAM 44, a flash memory 45, and an input/output interface (hereinafter, which may be referred to as an I/O I/F) 49 interconnected via a data bus. The ROM 42 stores programs 42A to be executed by the CPU 41 to take control of the printer 1. The CGROM 43 stores print dot pattern data for printing characters. The characters include at least one of letters, letter strings, numerals, symbols, figures, and illustrations. The RAM 44 is configured to temporarily store data. The RAM 44 includes a receive buffer 44A configured to temporarily store print data received from an external device. The flash memory 45 is configured to store characters acquired from an external device.

The I/O I/F 49 is connected with an operation interface 17, drive circuits 71, 72, 73, 74, 75, and 76, and an external connection I/F 77. The drive circuit 71 includes an electronic circuit configured to drive the print head 51. The drive circuit 72 includes an electronic circuit configured to drive a conveyance motor 88 for rotating the tape driving shaft 55 and the ribbon winding shaft 56. The drive circuit 73 includes an electronic circuit configured to drive the cut motor 89 for operating the cutter 57. The drive circuit 74 includes an electronic circuit configured to drive the print head 61. The drive circuit 75 includes an electronic circuit configured to drive a conveyance motor 98 for rotating the movable conveyance roller 62 and the ribbon winding shaft 63. The drive circuit 76 includes an electronic circuit configured to drive a cut motor 99 for operating the cutter 64.

The external connection I/F 77 is an interface for connecting an external device with the printer 1. In the illustrative embodiment, a PC 2, as an external device, is connected with the printer 1 via the external connection I/F 77. In the PC 2, an editor is installed that is an application program for the user to edit page images. Each page image represents print contents, including at least one character, for a single unit of page. The user edits page images with the editor on the PC 2, and thereafter issues an instruction to print the page images. In this case, a CPU (not shown) of the PC 2 transmits to the printer 1 a print command for instructing the printer 1 to print the edited page images. In the illustrative embodiment, the print command indicates which print medium (the tape 8 or the tube 9) the page images are to be printed on, the number of pages to be printed, and cut information.

Further, the CPU of the PC 2 sequentially generates line-by-line print data based on the edited page images, and sequentially transmits the generated print data to the printer 1. Each piece of the line-by-line print data causes the printer 1 to print, as a print unit, a single line of the page images to be printed by the print head 51 or the print head 61. Thereby, a plurality of pieces of print data, required for printing all of the page images to be printed, are sequentially transmitted from the PC 2 to the printer 1. When there exist a plurality of page images to be printed, a plurality of pieces of print data, each of which represents a corresponding page image, are transmitted in accordance with a sequence in which the plurality of page images are to be printed.

In the printer 1, the received print command and the received print data are stored into the receive buffer 44A. The CPU 41 reads the print command and the print data out of the receive buffer 44A in the stored order. When reading out the print command from the receive buffer 44A, the CPU 41 begins to perform a below-mentioned printed matter producing process. When reading out print data from the receive buffer 44A, the CPU 41 converts the print data into image data of a single line, based on the print dot pattern data stored in the CGROM 43. Then, the CPU 41 stores the image data generated through the conversion, into an image buffer (not shown) of the RAM 44. The CPU 41 executes the following printed matter producing process while sequentially reading out image data stored in the image buffer.

When reading out a print command regarding the tape 8, the CPU 41 starts the printed matter producing process on the tape 8. As shown in FIG. 3, the conveyance motor 88 rotates the tape driving shaft 55 and the ribbon winding shaft 56 thereby rotating the tape driving roller 81 and the ribbon winding spool 82. Along with rotation of the tape driving roller 81, an unused tape 8 is pulled out of the tape cassette 80. Along with rotation of the ribbon winding spool 82, an unused ink ribbon is pulled out of the tape cassette 80. The pulled-out tape 8 and the pulled-out ink ribbon 86 are fed between the print head 51 and the platen roller 53.

The print head 51 prints characters on the tape 8 with the ink ribbon, based on the image data sequentially read out from the image buffer, in synchronization with conveyance of the tape 8. The used ink ribbon is wound by the ribbon winding spool 82. The printed tape 8 is conveyed into the conveyance guide 23 by the movable conveyance roller 54 and the tape driving roller 81. Further, the printed tape 8 is cut by the cutter 57 on a page-image-by-page-image basis, and discharged from the tape outlet 14.

When reading out a print command regarding the tube 9, the CPU 41 starts a printed matter producing process on the tube 9. As shown in FIG. 3, the conveyance motor 98 rotates the movable conveyance roller 62 to convey the tube 9 in the tube attachment section 40, and rotates the ribbon winding shaft 63 to rotate the ribbon winding spool 91. Along with rotation of the ribbon winding spool 91, an unused ink ribbon is pulled out of the ribbon cassette 90. The pulled-out ink ribbon is fed between the print head 61 and the movable conveyance roller 62.

The print head 61 prints characters on the tube 9 with the ink ribbon, based on the image data sequentially read out from the image buffer, in synchronization with conveyance of the tube 9. The used ink ribbon is wound by the ribbon winding spool 91. The printed tube 9 is conveyed downstream of the print head 61 in the conveyance direction of the tube 9 on a conveyance path, by the movable conveyance roller 62. Further, the printed tube 9 is cut by the cutter 64 on a page-image-by-page-image basis, and discharged from the tube outlet 16.

Referring to FIGS. 5 to 17, a main process for the printed matter producing process will be described. FIGS. 10A to 10E schematically show a positional relationship among the tape 8, the print head 51, and the cutter 57 in the printed matter producing process for the sake of easy understanding (the same applies to FIGS. 11A to 13, 15, and 17). When reading out the print command from the receive buffer 44A, the CPU 41 launches the main process by loading and executing one or more programs 42A stored in the ROM 42. In the following description, a printed matter producing process for the tape 8 to be executed based on the main process will be exemplified. Nonetheless, it is noted that the below-exemplified printed matter producing process may be applied for the tube 9.

In the illustrative embodiment, a case where the tape 8 is half-cut on a page-image-by-page-image basis. As shown in FIGS. 10A to 10E, a cutter position T2 is a position where the tape 8 is cut in a width direction by the cutter 57. A head position T1 is a position where a single line is printed as a partial image of character by the print head 51. The cutter position T2 is located downstream of the head position T1 in the conveyance direction of the tape 8. A distance L1 (e.g., 22.3 mm) is a distance between the head position T1 and the cutter position T2 in the conveyance direction of the tape 8. The CPU 41 may identify a position of the tape 8 in the conveyance direction based on a conveyance distance of the tape 8 corresponding to the number of pulses applied to the conveyance motor 88.

Figure 5:
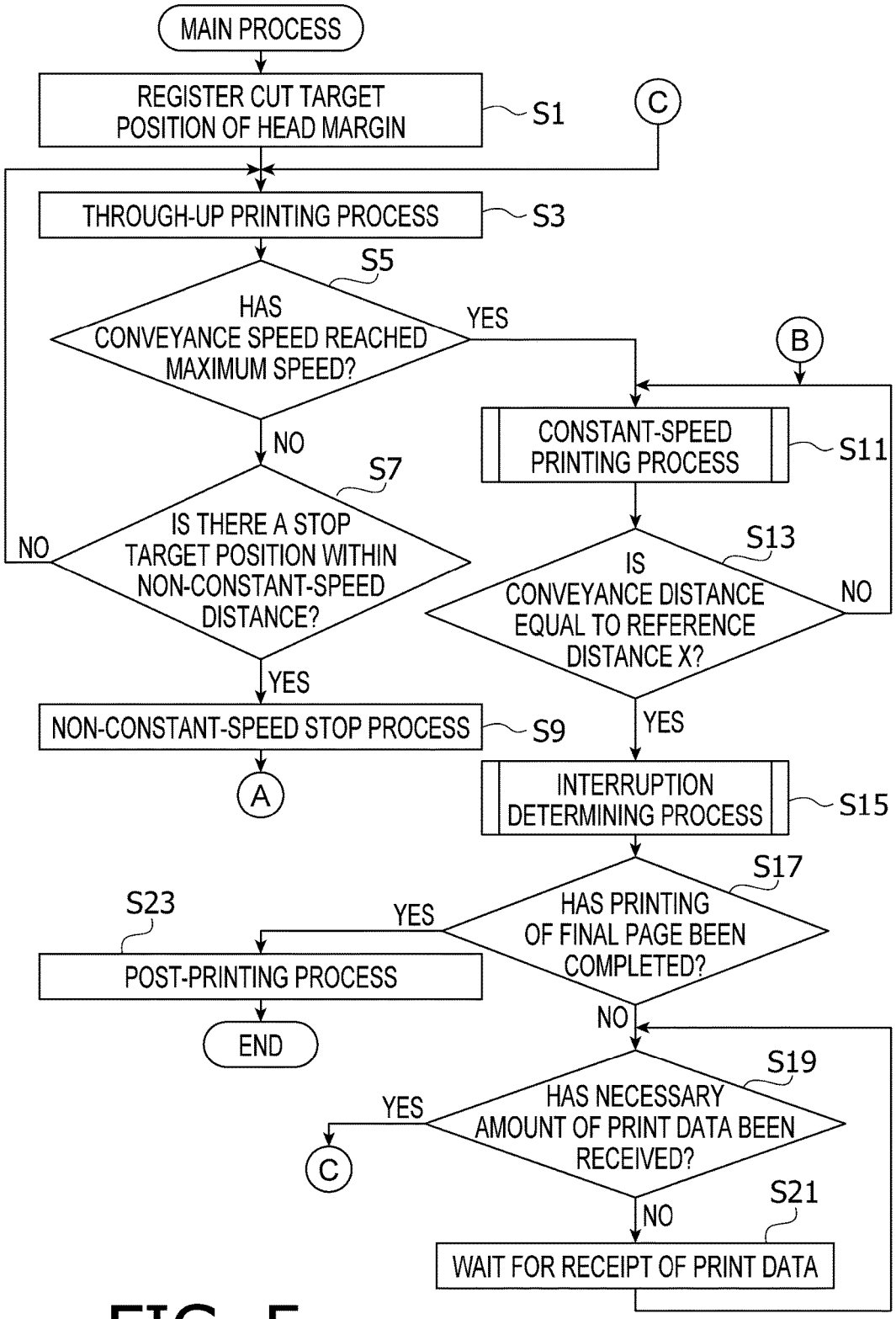
FIG. 5 is a flowchart showing a procedure of a main process to be executed by the printer in the illustrative embodiment according to one or more aspects of the present disclosure.

As shown in FIG. 5, the CPU 41 registers a cut target position of a head margin in the RAM 44 (S1). The cut target position is a position on the tape 8 to be cut by the cutter 57. The cut target position of the head margin corresponds to a head line of a page image (hereinafter referred to as a top page) to be first printed after the main process is started. When the main process is started, the head line of the top page is in the head position T1. In this case, when the tape 8 is conveyed over the distance L1, the head line of the top page reaches the cutter position T2. Accordingly, the cut target position of the head margin is a position on the tape 8 that coincides with the cutter position T2 in the conveyance direction when the tape 8 is conveyed over the distance L1 from a current position in the conveyance direction.

Subsequently, the CPU 41 performs a through-up printing process (S3). The through-up printing process is a print control process of controlling the print head 51 to print an image on the tape 8 while controlling the conveyance motor 88 to accelerate a conveyance speed of the tape 8 at a particular acceleration. Specifically, the CPU 41 accelerates the conveyance speed of the tape 8 at the particular acceleration by pulse control of the conveyance motor 88. The CPU 41 drives and controls the print head 51 to print characters on the tape 8 in synchronization with the conveyance speed of the tape 8.

Next, the CPU 41 determines whether the conveyance speed of the tape 8 has reached a particular maximum speed (S5). When determining that the conveyance speed of the tape 8 has reached the particular maximum speed (S5: Yes), the CPU 41 performs a constant-speed printing process (S11). The constant-speed printing process is a print control process of controlling the print head 51 to print an image on the tape 8 while controlling the conveyance motor 88 to maintain the maximum speed as the conveyance speed of the tape 8.

Figure 6:
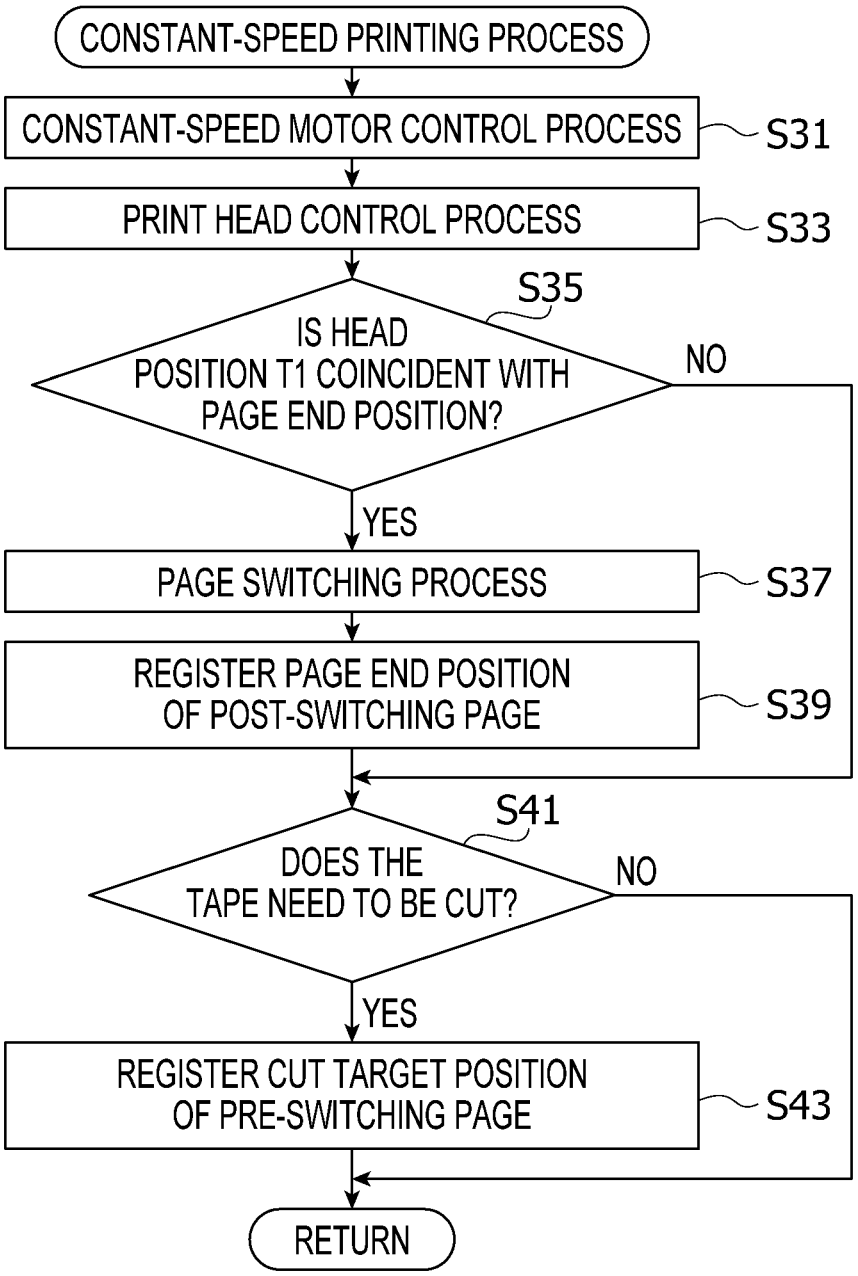
FIG. 6 is a flowchart showing a procedure of a constant-speed printing process to be executed by the printer in the illustrative embodiment according to one or more aspects of the present disclosure.

As shown in FIG. 6, in the constant-speed printing process, the CPU 41 first performs a constant-speed motor control process (S31). Specifically, in S31, the CPU 31 maintains the particular maximum speed as the conveyance speed of the tape 8 by pulse control of the conveyance motor 88. Subsequently, the CPU 41 performs a print head control process (S33). Specifically, in S33, the CPU 41 drives and controls the print head 51 to print characters on the tape 8 in synchronization with the conveyance speed of the tape 8.

Next, the CPU 41 determines whether the head position T1 is coincident with a page end position in the conveyance direction (S35). The page end position is a position on the tape 8 where printing of one page image by the print head 51 is completed. When determining that the head position T1 is coincident with the page end position in the conveyance direction (S35: Yes), the CPU 41 performs a page switching process (S37). For instance, in S37 the CPU 41 may initialize parameters used for each page image to be printed, in the RAM 44. Further, the CPU 41 may adjust a position of an image included in a next page image to be printed, relative to the tape 8 being conveyed.

Further, the CPU 41 registers the page end position of a post-switching page in the RAM 44 (S39). The post-switching page is a page image immediately before being printed by the print head 51. Specifically, the CPU 41 registers, in the RAM 44, the page end position of the post-switching page as a position on the tape 8 that coincides with the head position T1 in the conveyance direction when the tape 8 is conveyed over a print length of the post-switching page from a current position in the conveyance direction. After S39, or when determining that the head position T1 is not coincident with the page end position in the conveyance direction (S35: No), the CPU 41 determines whether the tape 8 needs to be cut (S41).

In the illustrative embodiment, when the head position T1 is coincident with the page end position of a cut target page in the conveyance direction, the CPU 41 determines that the tape 8 needs to be cut (S41: Yes). The cut target page is a page image to be cut in the page end position thereof. The CPU 41 may determine whether a page image to be surveyed is a cut target page based on print command. When determining that the tape 8 needs to be cut (S41: Yes), the CPU 41 registers a cut target position of a pre-switching page in the RAM 44 (S43). The pre-switching page is a page image immediately after having been completely printed by the print head 51. Specifically, the CPU 41 registers, in the RAM 44, the cut target position of the pre-switching page as a position on the tape 8 that coincides with the cutter position T1 in the conveyance direction when the tape 8 is conveyed over the distance L1 from a current position in the conveyance direction. After S43, or when determining that the tape 8 does not need to be cut (S41: No), the CPU 41 returns to the main process (see FIG. 5).

As shown in FIG. 5, after S11, the CPU 41 determines whether a conveyance distance of the tape 8 conveyed from a stop state of the tape 8 or after the last-executed S13 is equal to a predetermined reference distance X (e.g., 100 dots=7 mm) (S13). When determining that the conveyance distance of the tape 8 is equal to the reference distance X (S13: Yes), the CPU 41 performs a below-mentioned interruption determining process (S15). When determining that the conveyance distance of the tape 8 is not equal to the reference distance X (S13: No), the CPU 41 goes back to S11 and continuously performs the constant-speed printing process.

Figure 7:
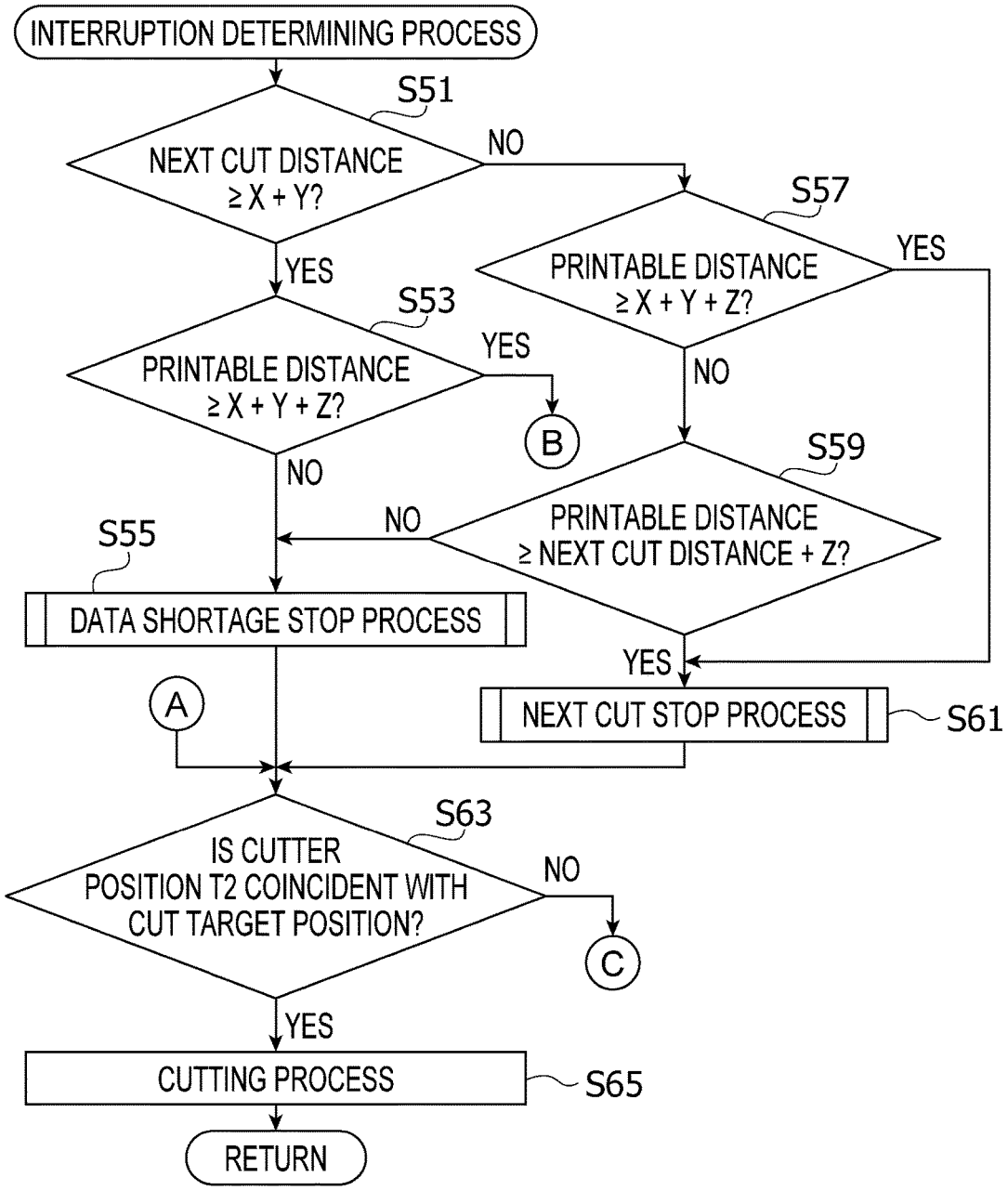
FIG. 7 is a flowchart showing a procedure of an interruption determining process to be executed by the printer in the illustrative embodiment according to one or more aspects of the present disclosure.

As shown in FIG. 7, in the interruption determining process, the CPU 41 first determines whether a next cut distance is equal to or more than a sum of the reference distance X and a through-down amount Y (S51). The next cut distance is a distance between the cutter position T2 and a next cut position in the conveyance direction. The next cut position is a cut target position closest to the cutter position T2 among cut target positions registered in the RAM 44. The through-down amount Y is a distance over which the tape 8 is conveyed while the conveyance speed of the tape 8 is decelerated from the maximum speed to zero. For instance, the through-down amount Y may be a distance of 75 dots (which is nearly equal to 5 mm).

When determining that the next cut distance is equal to or more than the sum of the reference distance X and the through-down amount Y (S51: Yes), the CPU 41 determines whether a printable distance is equal to or more than a sum of the reference distance X, the through-down amount Y, and an offset Z (S53). The printable distance is a distance of a printable range in the conveyance direction. The printable range is a range in which an image is allowed to be printed with the number of lines corresponding to a data amount of print data stored in the receive buffer 44A. In the printer 1, when the conveyance distance of the tape 8 is too short, it might result in deterioration of the quality of a printed image. The offset Z is a lower limit of a particular conveyance distance that enables to ensure an acceptable quality level of an image to be printed while the tape 8 is conveyed over the particular conveyance distance from start to stop of the conveyance and the printing of the tape 8.

When determining that the printable distance is equal to or more than the sum of the reference distance X, the through-down amount Y, and the offset Z (S53: Yes), the CPU 41 goes back to S11 and continuously performs the constant-speed printing process. Meanwhile, when determining that the printable distance is not equal to or more than the sum of the reference distance X, the through-down amount Y, and the offset Z (S53: No), the CPU 41 performs a data shortage stop process (S55).

Figure 8:
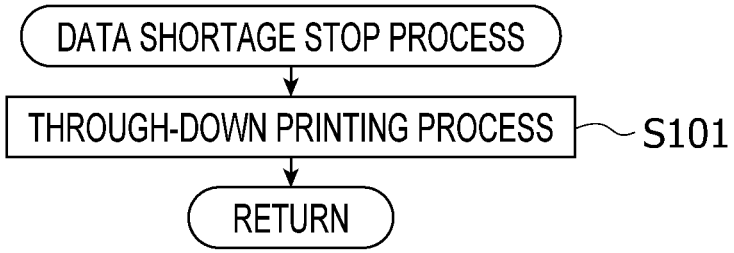
FIG. 8 is a flowchart showing a procedure of a data shortage stop process to be executed by the printer in the illustrative embodiment according to one or more aspects of the present disclosure.

As shown in FIG. 8, in the data shortage stop process, the CPU 41 first performs a through-down printing process (S101). Through-down printing process is a print control process of controlling the print head 51 to print an image while controlling the conveyance motor 88 to decelerate the conveyance speed of the tape 8 at a particular deceleration. Specifically, the CPU 41 decelerates the conveyance speed of the tape 8 at the particular deceleration by pulse control of the conveyance motor 88. The CPU 41 drives and controls the print head 51 to print characters on the tape 8 in synchronization with the conveyance speed of the tape 8. When the conveyance speed of the tape 8 is decelerated to zero, the conveyance and the printing of the tape 8 are stopped.

As described above, the through-down printing process is started at the same time as when the data shortage stop process in S55 is started. Therefore, the conveyance and the printing of the tape 8 are stopped at a point of time when the tape 8 has been conveyed over the through-down amount Y. At this time, a shortest stop position of the tape 8 is coincident with the head position T1 in the conveyance direction. The shortest stop position is located the through-down amount Y upstream of the head position T1 in the conveyance direction immediately before the data shortage stop process in S55 is started. After S101, the CPU 41 returns to the interruption determining process (see FIG. 7).

As shown in FIG. 7, when determining that the next cut distance is not equal to or more than the sum of the reference distance X and the through-down amount Y (S51: No), the CPU 41 determines whether the printable distance is equal to or more than the sum of the reference distance X, the through-down amount Y, and the offset Z in the same manner as executed in S53 (S57). When determining that the printable distance is not equal to or more than the sum of the reference distance X, the through-down amount Y, and the offset Z (S57: No), the CPU 41 determines whether the printable distance is equal to or more than a sum of the next cut distance and the offset Z (S59).

When determining that the printable distance is not equal to or more than the sum of the next cut distance and the offset Z (S59: No), the CPU 41 goes to S55. In S55, the CPU 41 performs the data shortage stop process to stop the conveyance and the printing of the tape 8. Meanwhile, when determining that the printable distance is equal to or more than the sum of the reference distance X, the through-down amount Y, and the offset Z (S57: Yes), or when determining that the printable distance is equal to or more than the sum of the next cut distance and the offset Z (S59: Yes), the CPU 41 performs a next cut stop process (S61).

Figure 9:
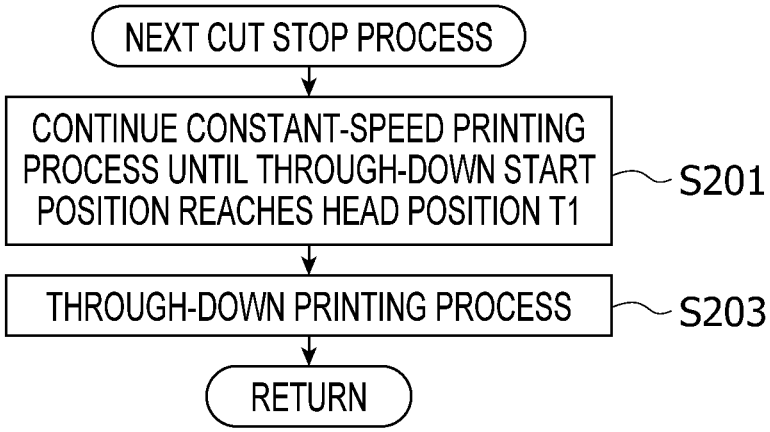
FIG. 9 is a flowchart showing a procedure of a next cut stop process to be executed by the printer in the illustrative embodiment according to one or more aspects of the present disclosure.

As shown in FIG. 9, in the next cut stop process, firstly, the CPU 41 continues the constant-speed printing process until a through-down start position of the tape 8 reaches the head position T1 (S201). The through-down start position in S201 is such a position as to coincide with the head position T1 in the conveyance direction when the tape 8 is conveyed until the next cut distance has become equal to the through-down amount Y. Thus, in other words, in S201, the CPU 41 continues the constant-speed printing process until the next cut distance becomes equal to the through-down amount Y. When the tape 8 is conveyed until the through-down start position thereof has reached the head position T1, the CPU 41 performs the through-down printing process in the same manner as executed in S101 (S203). Thereby, the conveyance and the printing of the tape 8 are stopped at such timing that the cutter position T2 coincides with the next cut position in the conveyance direction. After S203, the CPU 41 returns to the interruption determining process (see FIG. 7).

As shown in FIG. 7, after execution of S55 or S61, the CPU 41 determines whether the cutter position T2 is coincident with the cut target position registered in the RAM 44 in the conveyance direction (S63). When determining that the cutter position T2 is coincident with the cut target position in the conveyance direction (S63: Yes), the CPU 41 performs a cutting process (S65). Specifically, in S65, the CPU 41 controls the cutter 57 to cut the cut target position of the tape 8 that is coincident with the cutter position T2 in the conveyance direction. Thereafter, the CPU 41 returns to the main process (see FIG. 5).

When determining that the cutter position T2 is not coincident with the cut target position in the conveyance direction (S63: No), since the conveyance and the printing of the tape 8 have been interrupted in S55, the CPU 41 goes back to S3. In this case, after at least print data equal to or more than the number of lines corresponding to the offset Z has been stored in the receive buffer 44A, the CPU 41 resumes the conveyance and the printing of the tape 8.

As shown in FIG. 5, when determining that the conveyance speed of the tape 8 has not reached the particular maximum speed (S5: No), the CPU 41 determines whether there is a stop target position within a non-constant-speed distance (S7). The non-constant-speed distance is a sum of a through-up amount and the aforementioned through-down amount Y. The through-up amount is a distance over which the tape 8 is conveyed while the conveyance speed of the tape 8 is accelerated from zero to the maximum speed in the aforementioned through-up printing process. For instance, the through-up amount may be a distance of 75 dots (which is nearly equal to 5 mm). Accordingly, in the illustrative embodiment, for instance, the non-constant-speed distance may be a distance of 150 dots (which is nearly equal to 10 mm). The stop target position is one of the cut target position registered in the RAM 44 and a bottom line of the printable range. The bottom line of the printable range is a position where a single line of print data stored at the end of the receive buffer 44A is to be printed.

When the cut target position reaches the cutter position T2 or the bottom line of the printable range reaches the head position T1 within a period of time during which the tape 8 is printed while being conveyed over the non-constant-speed distance, the CPU 41 determines that there is a stop target position within the non-constant-speed distance (S7: Yes). In this case, the CPU 41 performs a non-constant-speed stop process (S9). Specifically, in S9, the CPU 41 adjusts each of the through-up amount and the through-down amount Y to be equal to a distance from a current position to the stop target position. It is noted that the current position denotes a position on the tape 8 that is currently coincident with a corresponding one of the cutter position T2 and the head position T1 in the conveyance direction. More specifically, when the stop target position is the cut target position, the current position is a position on the tape 8 that is currently coincident with the cutter position T2 in the conveyance direction. Meanwhile, when the stop target position is the bottom line of the printable range, the current position is a position on the tape 8 that is currently coincident with the head position T1 in the conveyance direction. The CPU 41 performs the through-up printing process based on the adjusted through-up amount, and thereafter performs through-down printing process based on the adjusted through-down amount. Thereby, the conveyance and the printing of the tape 8 are stopped when the cut target position coincides with the cutter position T2 or when the bottom line of the printable range coincides with the head position T1.

After S9, the CPU 41 goes to S63. Thereby, when the stop target position is the cut target position, the cut target position of the tape 8 is cut (S65). Meanwhile, when the stop target position is the bottom line of the printable range, the CPU 41 goes back to S3. In this case, after at least print data equal to or more than the number of lines corresponding to the offset Z has been stored in the receive buffer 44A, the CPU 41 resumes the conveyance and the printing of the tape 8 in the through-up printing process.

After S15, the CPU 41 determines whether printing of a page image (hereinafter referred to as a final page) to be finally printed has been completed (S17). When determining that printing of the final page has not been completed (S17: No), the CPU 41 determines whether a necessary amount of print data has been received (S19). For example, when unprinted print data stored in the receive buffer 44A is less than 500 lines, the CPU 41 may determine that a necessary amount of print data has not been received (S19: No). In this case, the CPU 41 waits for receipt of print data for a particular period of time (S21), and goes back to S19. When determining that a necessary amount of print data has been received (S19: Yes), the CPU 41 goes back to S3 and starts the through-up printing.

When determining that printing of the final page has been completed (S17: Yes), the CPU 41 performs a post-printing process (S23). For instance, when there is an unprocessed cut target position stored in the RAM 44, the CPU 41 continues to convey and cut the tape 8 until all of the cut target positions are cut. When there is not an unprocessed cut target position stored in the RAM 44, the CPU 41 further conveys the tape 8 and discharges a label with a page image printed thereon via the tape outlet 14 (see FIG. 1). Thereafter, the CPU 41 terminates the main process.

Referring to FIGS. 10A to 13, a specific explanation will be provided of a printed matter producing process based on the main process. FIGS. 10A to 10E exemplify basic operations for producing a label 8A with a page image showing characters "test 2015/01/01" printed thereon.

Figure 10A:
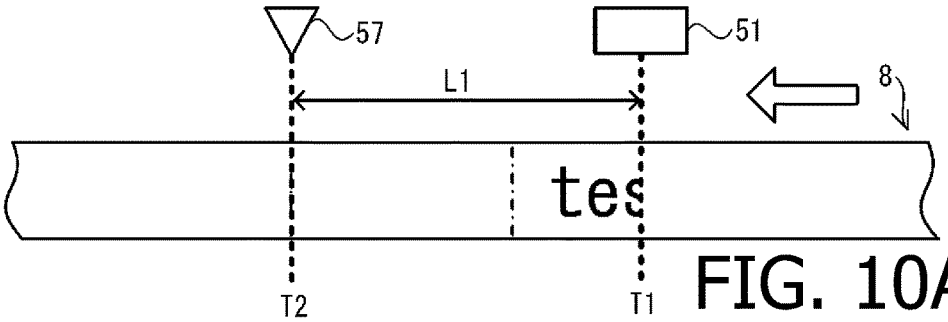
Figure 10B:
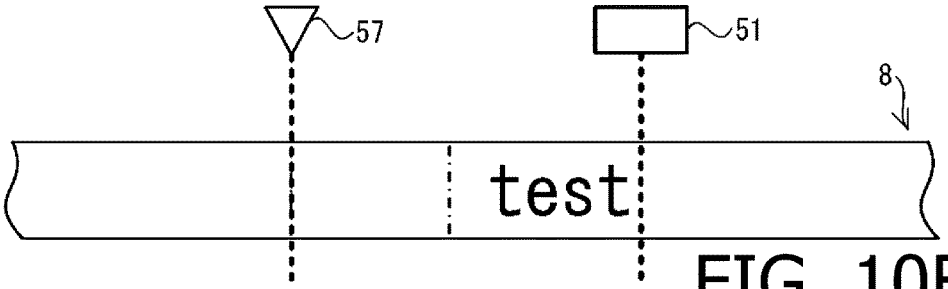

As shown in FIG. 10A, when the main process is started, firstly, the cut target position of the head margin is registered, and the through-up printing process for the page image is performed (S1 and S3). When the conveyance speed of the tape 8 reaches the maximum speed, the constant-speed printing process for the page image is performed (S5: Yes, and S11). As shown in FIG. 10B, when a remaining amount of print data stored in the receive buffer 44A runs low (S51: Yes, and S53: No), the through-down printing process for the page image is performed (S55), and the conveyance and the printing of the tape 8 are stopped.

Figure 10C:
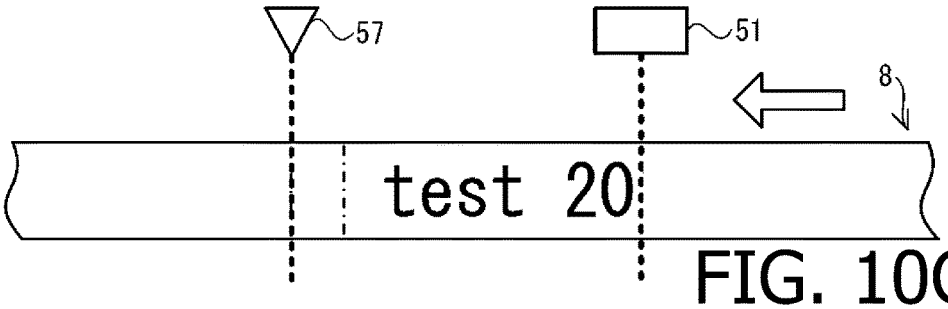
Figure 10D:
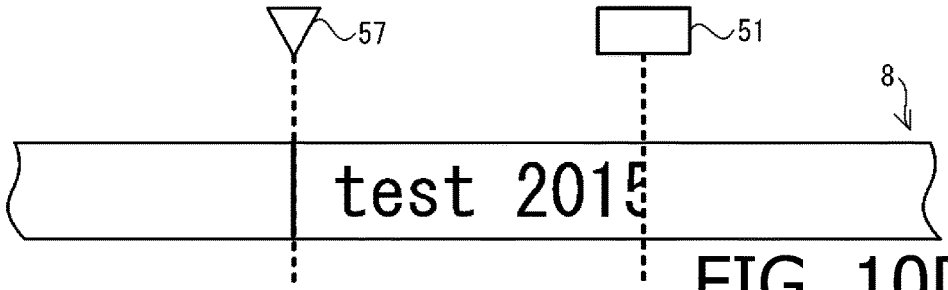

Afterward, as shown in FIG. 10C, when the amount of print data stored in the receive buffer 44A increases, the through-up printing process for the page image is performed (S3), and the conveyance and the printing of the tape 8 are resumed. When the conveyance speed of the tape 8 reaches the maximum speed, the constant-speed printing process for the page image is performed (S5: Yes, and S11). As shown in FIG. 10D, the cut target position of the head margin becomes close to the cutter position T2 (S51: No, and S57: Yes), the through-down printing process for the page image is performed (S61), and the conveyance and the printing of the tape 8 are stopped. The cut target position of the head margin is half-cut in the cutter position T2 (S65).

Figure 10E:
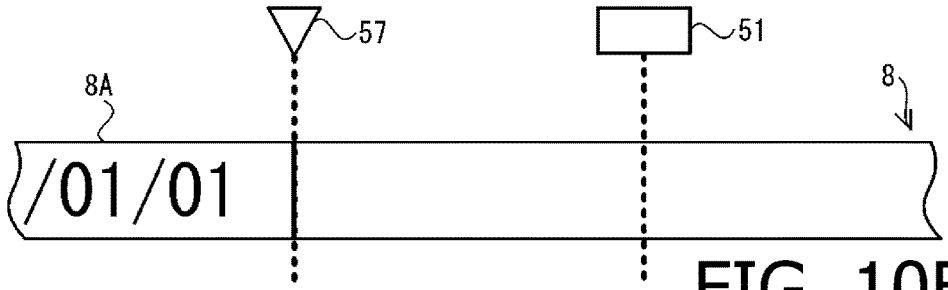

Afterward, when the printing of the page image has been completed, the page end position of the page image is registered as a cut target position (S35 to S43). As shown in FIG. 10E, when the page end position becomes close to the cutter position T2 (S51: No, and S57: Yes), the through-down printing process is performed (S61), and the conveyance of the tape 8 is stopped. The page end position is half-cut (S65), and a label 8A with the page image printed thereon is produced.

Referring to FIGS. 11A and 11B, a comparative example will be provided in which a label 8A is produced by a known printer. In a situation shown in FIG. 11A, as the remaining amount of print data stored in the receive buffer 44A runs low during the constant-speed printing process for the page image, the through-down printing process for the page image is performed, and the conveyance and the printing of the tape 8 are stopped. The cut target position of the head margin is located upstream of the cutter position T2 in the conveyance direction. In the present example, the next cut distance D1 is a distance between the cutter position T2 and the cut target position of the head margin. The next cut distance D1 is less than the offset Z.

Afterward, in a situation shown in FIG. 11B, after the conveyance and the printing of the tape 8 are resumed, the tape 8 is conveyed over the next cut distance D1. The conveyance and the printing of the tape 8 are stopped such that the cut target position of the head margin coincides with the cutter position T2 in the conveyance direction. The cut target position of the head margin is half-cut in the cutter position T2. In the present example, the next cut distance D1 is less than the offset Z. Therefore, it is difficult to perform stable print control for the tape 8 to be conveyed over the next cut distance D1. Thus, it might result in deterioration of the quality of an image printed on the tape 8.

Referring to FIGS. 12 and 13, the printed matter producing process based on the aforementioned main process will be described in comparison with the comparative example shown in FIGS. 11A and 11B. In the following example, the cut target position of the head margin corresponds to the next cut position. The next cut distance D1 is a distance between the cutter position T2 and the next cut position. The printable distance D2 is a width of lines arranged between the head position T1 and a position upstream of the head position T1 in the conveyance direction based on the amount of print data stored in the receive buffer 44A.

In an example shown in FIG. 12, it is determined that the conveyance distance of the tape 8 is equal to the reference distance X (S13: Yes) at timings P1 and P2 while the page image is being printed. At the timing P2, the printable distance D2 is more than the next cut distance D1. In the present example, the conveyance and the printing of the tape 8 are stopped for the first time in order to cut the next cut position of the tape 8. Thereafter, the conveyance and the printing of the tape 8 are stopped for the second time due to shortage of print data stored in the receive buffer 44A. A distance over which the tape 8 is conveyed between the first stop and the second stop may be referred to as an inter-stop distance H. For instance, at the timing P2, the interruption determining process (S15) may be performed in the following manner.

In the present example, the next cut distance D1 is less than the sum of the reference distance X and the through-down amount Y (S51: No). The printable distance D2 is equal to or more than the sum of the reference distance X, the through-down amount Y, and the offset Z (S57: Yes). Accordingly, the next cut stop process is performed (S61). Specifically, the through-down printing process is continued until a through-down start position Q of the tape 8 reaches the head position T1 (S201). Along with the conveyance of the tape 8, the next cut distance D1 and the printable distance D2 decrease. When the tape 8 is conveyed until the through-down start position Q thereof has reached the head position T1, the next cut distance D1 becomes equal to the through-down amount Y. The through-down printing process is performed (S203), and the conveyance and the printing of the tape 8 are stopped such that the cutter position T2 coincides the next cut position in the conveyance direction. The next cut position is half-cut (S63: Yes, and S65).

In the present example, there is no print data newly stored into the receive buffer 44A after the timing P2. At a point of time when the conveyance and the printing of the tape 8 have been stopped for the first time as described above, the bottom line of the printable range is located a distance equal to or more than the offset Z upstream of the head position T1 in the conveyance direction. The inter-stop distance H is equal to the printable distance D2 at the point of time when the conveyance and the printing of the tape 8 have been stopped for the first time, and is less than the non-constant-speed distance (S7: Yes). Accordingly, after the conveyance and the printing of the tape 8 are resumed in the through-up printing process (S3), the non-constant-speed stop process is performed (S9). Namely, the conveyance and the printing of the tape 8 are stopped at a point of time when the tape 8 has been conveyed and printed over the inter-stop distance H via the through-up printing process and the through-down printing process. The inter-stop distance H is more than the offset Z. Therefore, it is possible to perform stable print control for the tape 8 to be conveyed over the inter-stop distance H. Thus, it is possible to prevent deterioration in quality of an image to be printed on the tape 8 during the conveyance of the tape 8 over the inter-stop distance H.

In an example shown in FIG. 13, while the page image is being printed, it is determined at the timing P1 that the conveyance distance of the tape 8 is equal to the reference distance X (S13: Yes). At the timing P1, the next cut distance D1 is more than the printable distance D2. In the present example, the conveyance and the printing of the tape 8 are stopped for the first time due to shortage of print data stored in the receive buffer 44A. Thereafter, the conveyance and the printing of the tape 8 are stopped for the second time in order to cut the next cut position. For instance, at the timing P1, the interruption determining process (S15) may be performed in the following manner.

In the present example, the next cut distance D1 is equal to or more than the sum of the reference distance X and the through-down amount Y (S51: Yes). The printable distance D2 is less than the sum of the reference distance X, the through-down amount Y, and the offset Z (S53: No). Accordingly, the data shortage stop process is performed (S61). Specifically, the through-down printing process is started from the timing P1 (S101). The conveyance and the printing of the tape 8 are stopped at a point of time when the tape 8 has been conveyed and printed over the through-down amount Y. At this time, the next cut distance D1 is made less by through-down amount Y than at the timing P1. At this time, the next cut position is located a distance equal to or more than the offset Z upstream of the cutter position T2 in the conveyance direction.

In the present example, while the step S101 is being executed, new print data is stored into the receive buffer 44A. At the point of time when the conveyance and the printing of the tape 8 have been stopped for the first time as described above, the printable distance D2 is more than the next cut distance D1. The inter-stop distance H is equal to the next cut distance D1 at the point of time when the conveyance and the printing of the tape 8 have been stopped for the first time, and is more than the non-constant-speed distance (S7: No). Accordingly, after the conveyance and the printing of the tape 8 are resumed in the through-up printing process (S3), the constant-speed printing process is performed (S11).

Further, it is determined that the conveyance distance of the tape 8 is equal to the reference distance X at the timing P2 (S13: Yes), and the interruption determining process (S15) is performed. In the same manner as exemplified in FIG. 12, the next cut stop process is performed (S61). Thereby, at a point of time when the tape 8 has been conveyed and printed over the inter-stop distance H, the conveyance and the printing of the tape 8 are stopped, and the next cut position is half-cut (S63: Yes, and S65). The inter-stop distance H is more than the offset Z. Therefore, it is possible to perform stable print control for the tape 8 to be conveyed over the inter-stop distance H. Thus, it is possible to prevent deterioration in quality of an image to be printed on the tape 8 during the conveyance of the tape 8 over the inter-stop distance H.

It is noted that, instead of the process shown in FIG. 8, one of the processes shown in FIGS. 14 and 16 may be employed as a data shortage stop process (S55). In a data shortage stop process of a first modification shown in FIG. 14, the CPU 41 first calculates a stoppable range (S111). The stoppable range is a range between the aforementioned shortest stop position and a longest stop position, within the aforementioned printable range. The longest stop position denotes a position located a specific distance upstream of the head position T1 in the conveyance direction immediately before the start of S55. The specific distance is obtained by subtracting the offset Z from the next cut distance.

Subsequently, the CPU 41 calculates a prospective area having the smallest number of print dots within the stoppable range (S113). In other words, the prospective area is an area (e.g., an unprinted area of the page image) corresponding to print lines having the smallest number of dots to be driven in a line-by-line printing operation performed by the print head 51. Next, the CPU 41 sets, in the RAM 44, a center position of the prospective area in the conveyance direction as a stop target position (S115).

The CPU 41 continues the constant-speed printing process until a through-down start position of the tape 8 reaches the head position T1 (S117). The through-down start position in S117 is such a position as to coincide with the head position T1 in the conveyance direction when the tape 8 is conveyed until a distance between the head position T1 and the stop target position in the conveyance direction has become equal to the through-down amount Y. When the tape 8 is conveyed until the through-down start position thereof has reached the head position T1, the CPU 41 performs the through-down printing process in the same manner as executed in S101 (S119). Thereby, the conveyance and the printing of the tape 8 are stopped such that the head position T1 coincides with the stop target position in the conveyance direction. After S119, the CPU 41 goes back to the interruption determining process (see FIG. 7).

Referring to FIG. 15, an explanation will be provided of a specific example of a printed matter producing process including the data shortage stop process of the first modification. In an example shown in FIG. 15, the interruption determining process (S15) is performed at the timing P1, and the data shortage stop process shown in FIG. 14 is performed (S61). Specifically, a stoppable range 8B between a shortest stop position W1 and a longest stop position W2 is first calculated (S111). The shortest stop position W1 is located the through-down amount Y upstream of the head position T1 in the conveyance direction. The longest stop position W2 is located a specific distance upstream of the head position T1 in the conveyance direction. The specific distance is obtained by subtracting the offset Z from the next cut distance D1.

Subsequently, a white portion of the stoppable range 8B that has the smallest number of print dots is calculated as a prospective area 8C (S113). A center position of the prospective area 8C in the conveyance direction is set as a stop target position W3 (S115). The constant-speed printing process is continued until a through-down start position Q of the tape 8 reaches the head position T1 (S117). When the tape 8 is conveyed until the through-down start position Q of the tape 8 has reached the head position T1, a distance between the head position T1 and the stop target position W3 in the conveyance direction becomes equal to the through-down amount Y. After the through-down printing process (S119) is started, the conveyance and the printing of the tape 8 are stopped such that the head position T1 coincides with the stop target position W3 in the conveyance direction. At this time, the next cut position (in the present example, the cut target position of the head margin) is located a distance equal to or more than offset Z upstream of the cutter position T2 in the conveyance direction.

In the present example, during the execution of S119, new print data is stored into the receive buffer 44A. Therefore, at a point of time when the conveyance and the printing of the tape 8 have been stopped for the first time as described above, the printable distance D2 is more than the next cut distance D1. The inter-stop distance H is equal to the next cut distance D1 at the point of time when the conveyance and the printing of the tape 8 have been stopped for the first time, and is less than the non-constant-speed distance (S7: Yes).

Accordingly, after the conveyance and the printing of the tape 8 are resumed in the through-up printing process, the non-constant-speed stop process is performed (S9). Namely, the next cut position is half-cut at a point of time when the tape 8 has been conveyed and printed over the inter-stop distance H via the through-up printing process and the through-down printing process. In this case, the inter-stop distance H is more than the offset Z. Therefore, it is possible to prevent deterioration in quality of an image to be printed on the tape 8 during the conveyance of the tape 8 over the inter-stop distance H.

In a data shortage stop process of a second modification shown in FIG. 16, the CPU 41 first calculates a limit stop position (S121). The limit stop position is an upstream end position of the aforementioned stoppable range in the conveyance direction. Specifically, when the printable distance is equal to or more than a value resulting from subtracting the offset Z from the next cut distance, the aforementioned longest stop position is equivalent to the limit stop position. When the printable distance is less than the value resulting from subtracting the offset Z from the next cut distance, the bottom line of the aforementioned printable range is equivalent to the limit stop position.

Subsequently, the CPU 41 continues the constant-speed printing process until a through-down start position of the tape 8 reaches the head position T1 (S123). The through-down start position in S123 is such a position as to coincide with the head position T1 in the conveyance direction when the tape 8 is conveyed until a distance between the head position T1 and the limit stop position in the conveyance direction has become equal to the through-down amount Y. During the execution of S123, the next cut distance and the printable distance decrease along with conveyance of the tape 8. Meanwhile, in response to new print data being stored into the receive buffer 44A, the printable distance increases. Therefore, at a point of time when the tape 8 is conveyed until the through-down start position thereof has reached the head position T1, the following process is performed.

The CPU 41 determines whether the printable distance is equal to or more than the sum of the next cut distance and the offset Z in the same manner as executed in S59 (S125). When determining that the printable distance is not equal to or more than the sum of the next cut distance and the offset Z (S125: No), the CPU 41 performs the through-down printing process in the same manner as executed in S101 (S127). Thereby, the conveyance and the printing of the tape 8 are stopped such that the head position T1 coincides with the limit stop position in the conveyance direction.

When determining that the printable distance is equal to or more than the sum of the next cut distance and the offset Z (S125: Yes), the CPU 41 determines whether the next cut distance is equal to or more than the sum of the reference distance X and the through-down amount Y in the same manner as executed in S51 (S129). When determining that the next cut distance is equal to or more than the sum of the reference distance X and the through-down amount Y in the same manner as executed in S51 (S129: Yes), the CPU 41 goes back to S11, and continuously performs the constant-speed printing process. When determining that the next cut distance is not equal to or more than the sum of the reference distance X and the through-down amount Y in the same manner as executed in S51 (S129: No), the CPU 41 performs the next cut stop process in the same manner as executed in S61 (S131). After execution of S127 or S131, the CPU 41 goes back to the interruption determining process (see FIG. 7).

Referring to FIG. 17, an explanation will be provided of a specific example of a printed matter producing process including the data shortage stop process of the second modification. In an example shown in FIG. 17, the interruption determining process (S15) is performed at the timing P1, and the data shortage stop process shown in FIG. 16 is carried out (S61). Specifically, a limit stop position W4 is first calculated (S121). The limit stop position W4 in the present example corresponds to the aforementioned longest stop position W2 (see FIG. 15). The constant-speed printing process is continued until the through-down start position Q of the tape 8 reaches the head position T1 (S123). When the tape 8 is conveyed until the through-down start position Q thereof has reached the head position T1, a distance between the head position T1 and the limit stop position W4 in the conveyance direction becomes equal to the through-down amount Y.

In the present example, there is no print data newly stored into the receive buffer 44A during the execution of S123. Therefore, at a point of time when the tape 8 is conveyed until the through-down start position Q thereof has reached the head position T1, the printable distance D2 is less than a sum of the next cut distance D1 and the offset Z (S125: No). Accordingly, the through-down printing process is started (S127). The conveyance and the printing of the tape 8 are stopped such that the head position T1 coincides with the limit stop position W4 in the conveyance direction. At this time, the next cut position (in the present example, the cut target position of the head margin) is located a distance equal to or more than the offset Z upstream of the cutter position T2 in the conveyance direction.

Further, in the present example, during the execution of S127, new print data is stored into the receive buffer 44A. Therefore, at the point of time when the conveyance and the printing of the tape 8 have been stopped for the first time as described above, the printable distance D2 is more than the next cut distance D1. The inter-stop distance H is equal to the next cut distance D1 at the point of time when the conveyance and the printing of the tape 8 have been stopped for the first time, and is less than the non-constant-speed distance (S7: Yes).

Accordingly, after the conveyance and the printing of the tape 8 are resumed in the through-up printing process (S3), the non-constant-speed stop process is performed (S9). Namely, the next cut position is half-cut at a point of time when the tape 8 has been conveyed and printed over the inter-stop distance H via the through-up printing process and the through-down printing process. In this case, the inter-stop distance H is more than the offset Z. Therefore, it is possible to prevent deterioration in quality of an image to be printed on the tape 8 during the conveyance of the tape 8 over the inter-stop distance H.

In the case where new print data is stored into the receive buffer 44A during the execution of S123, at a point of time when the tape 8 is conveyed until the through-down start position Q thereof has reached the head position T1, the printable distance D2 may be equal to or more than the sum of the next cut distance D1 and the offset Z (S125: Yes). In this case, when the next cut distance D1 is less than the sum of the reference distance X and the through-down amount Y (S129: No), the next cut stop process is performed (S131). Thereby, the conveyance and the printing of the tape 8 are not stopped even when the limit stop position W4 reaches the head position T1, but are continued until the next cut position reaches the cutter position T2. Thereafter, the next cut position is half-cut. Meanwhile, when the next cut distance D1 is equal to or more than the sum of the reference distance X and the through-down amount Y (S129: Yes), the constant-speed printing process is continued until the tape 8 is further conveyed over the reference distance X.

As described above, the printer 1 of the illustrative embodiment includes the conveyance motor 88, the RAM 44, the print head 51, the cutter 57, and the CPU 41. The conveyance motor 88 is configured to convey the long tape 8 in the conveyance direction along the conveyance path (e.g., the conveyance guide 23). The print head 51 is configured to sequentially print a plurality of page images on the tape 8 in the head position T1 on the conveyance path. Each page image represents a single unit of page. The cutter 57 is configured to cut the tape 8 in the cutter position T2 on the conveyance path. The cutter position T2 is located upstream of the head position T1 in the conveyance direction of the tape 8. The RAM 44 is configured to store therein a plurality of pieces of print data for printing each individual page image in a manner separated on a line-by-line basis. Each piece of print data expresses print contents of a single print line. The RAM 44 is further configured to store therein cut target positions as positions on the tape 8 to be cut by the cutter 57. The next cut distance is a distance between the next cut position and the cutter position T2 in the conveyance direction. The next cut position is closest to the cutter position T2 among cut target positions stored in the RAM 44 and located upstream of the cutter position T2 in the conveyance direction. The printable distance is a distance of the printable range in the conveyance direction. The printable range is a range within which an image is allowed to be printed with the number of lines corresponding to a data amount of print data stored in the RAM 44.

The CPU 41 performs a printing process of controlling the print head 51 to sequentially print page images on the tape 8 based on the print data stored in the RAM 44 while controlling the conveyance motor 88 to convey the tape 8 in the conveyance direction on the conveyance path (S3, S31, and S33). The CPU 41 stores into the RAM 44 a cut target position of each page image printed on the tape 8 (S1 and S43). The CPU 41 interrupts the printing process when the next cut distance is equal to or less than the printable distance. Thereby, the CPU 41 stops the tape 8 such that the next cut position of the tape 8 coincides with the cutter position T2 in the conveyance direction, and controls the cutter 57 to cut the tape 8 (S51: No, S57: Yes, and S61). When the next cut distance becomes more than the printable distance during the conveyance and the printing of the tape 8, the CPU 41 interrupts the printing process before the CPU 41 completes printing based on print data stored in the RAM 44. Thereby, the CPU 41 stops the tape 8 such that the next cut position of the tape 8 coincides with a position located a distance equal to or more than the offset Z upstream of the cutter position T2 in the conveyance direction (S51: Yes, S53: No, and S55). After the interruption of the printing process, the CPU 41 resumes the printing process (S19: Yes, S63: No, and S3).

Thereby, the printing process is resumed in a state where a distance equal to or more than the offset Z is secured between the next cut position and the cutter position T2. In other words, the tape 8 is conveyed over a distance equal to or more than the offset Z in a period of time between when the printing process has been resumed and when the printing process is interrupted in response to the next cut position reaching the cutter position T2. Accordingly, the printer 1 is enabled to properly perform consecutive printing and cutting of the tape 8 while preventing positional displacement and/or distortion of an image to be printed on the tape 8.

Further, each time the tape 8 is conveyed over the reference distance X during the execution of the printing process, the CPU 41 determines whether a first condition or a second condition is satisfied (S15). When determining that the first condition is satisfied, the CPU 41 stops the tape 8 such that the next cut position coincides with the cutter position T2 in the conveyance direction by controlling the conveyance motor 88 to decelerate the conveyance speed of the tape 8 from a particular speed to zero (S61). When determining that the second condition is satisfied, the CPU 41 stops the tape 8 such that the next cut position coincides with a position located a distance equal to or more than the offset Z upstream of the cutter position T2 in the conveyance direction by controlling the conveyance motor 88 to decelerate the conveyance speed of the tape 8 from the particular speed to zero (S55). The tape 8 is conveyed over the through-down amount Y while the conveyance speed is decelerated from the particular speed to zero.

The first condition includes a requirement that the next cut distance is less than the sum of the reference distance X and the through-down amount Y (S51: No), and a requirement that the printable distance is equal to or more than the sum of the reference distance X, the through-down amount Y, and the offset Z (S57: Yes). The second condition includes a requirement that the next cut distance is equal to or more than the sum of the reference distance X and the through-down amount Y (S51: Yes), and a requirement that the printable distance is less than the sum of the reference distance X, the through-down amount Y, and the offset Z (S53: No). Thereby, the printer 1 is enabled to interrupt the printing process at a more proper timing in consideration of the reference distance X, which corresponds to a timing to determine whether to interrupt the printing process, and the through-down amount Y for interrupting the printing process.

At a point of time when determining that the second condition is satisfied, the CPU 41 controls the conveyance motor 88 to start decelerating the conveyance speed of the tape 8 (S101). Thereby, it is possible to convey the tape 8 over a longer distance in a period of time between when the printing process has been resumed and when the printing process is interrupted in response to the next cut position reaching the cutter position T2. Accordingly, it is possible to further prevent positional displacement and/or distortion of an image to be printed on the tape 8 when the printing process is resumed.

The print head 51 is configured to perform a line-by-line printing operation with a print line as a print unit. Each print line includes a plurality of dots arranged in a direction perpendicular to the conveyance direction of the tape 8. When determining that the second condition is satisfied, the CPU 41 stops the tape 8 such that the head position T1 coincides with a smallest-amount print position in the conveyance direction (S111 to S119). The smallest-amount print position is a position corresponding to a print line with the smallest number of dots to be printed in the print line within the printable range. Thereby, the printing process is interrupted such that the head position T1 coincides in the conveyance direction with a position where a print amount (e.g., the number of dots to be printed) is the smallest within the printable range. Accordingly, it is possible to further prevent positional displacement and/or distortion of an image to be printed on the tape 8 when the printing process is resumed.

When determining that the second condition is satisfied, the CPU 41 stops the tape 8 such that the head position T1 coincides with the limit stop position in the conveyance direction (S121, S123, and S127). The limit stop position is an upstream end position of the stoppable range included in the printable range in the conveyance direction. The stoppable range is an area between the shortest stop position and the longest stop position in the conveyance direction. The shortest stop position is located the through-down amount Y upstream of the head position T1 in the conveyance direction. The longest stop position is located a specific distance upstream of the head position T1 in the conveyance direction. It is noted that the specific distance is obtained by subtracting the offset Z from the next cut distance.

Thereby, the tape 8 is conveyed over a shorter distance within a range equal to or more than the offset Z in a period of time between when the printing process has been resumed and when the printing process is interrupted in response to the next cut position reaching the cutter position T2. Accordingly, the printer 1 prints the print data already stored before the interruption of the printing process, as much as possible within such a range that the printer 1 is allowed to prevent positional displacement and/or distortion of an image to be printed on the tape 8 when the printing process is resumed. Thus, it is possible to achieve a fast printing operation.

When determining that a third condition is satisfied, the CPU 41 continuously performs the printing process without interrupting the printing process (S51: Yes, and S53: Yes). The third condition includes a requirement that the next cut distance is equal to or more than the sum of the reference distance X and the through-down amount Y (S51: Yes), and a requirement that the printable distance is equal to or more than the sum of the reference distance X, the through-down amount Y, and the offset Z (S53: Yes). Thereby, the printer 1 is allowed to continuously perform the printing process without interrupting the printing process.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

The main process (see FIG. 5) may be applied when a printed matter such as a label is produced not only with the tape 8 or the tube 9 but also with other print media. At least a part of the main process may be performed by a device (e.g., the PC 2) different from the printer 1. The print data stored in the receive buffer 44A is not limited to print data transmitted by the PC 2. The print data stored in the receive buffer 44A may be print data received from an external device via a network, or print data directly input into the printer 1 by the user.

The main process (see FIG. 5) may be performed by a printer (e.g., a printer 2 shown in FIGS. 18 and 19) different from the printer 1. In the following description, the printer 2 will be described. Regarding elements of the printer 2 that have the same functions as those of the printer 1, the same reference characters as used for the printer 1 in the aforementioned illustrative embodiment will be provided to them, and detailed explanations thereof will be omitted. In FIG. 19, a print unit 240, a cut unit 250, and a buttery 260 are shown by dashed virtual lines.

As shown in FIGS. 18 and 19, the printer 2 is configured to produce a label with a tape cassette 80 (see FIG. 3). The printer 2 includes a housing 200. The housing 200 includes a main body casing 210 and a plate-shaped cover 220. The main body casing 210 is formed in a rectangular parallelepiped shape having a vertical direction and a front-to-rear direction as longitudinal directions (i.e., longer-side directions) thereof, and a left-to-right direction as a transverse direction (i.e., a shorter-side directions) thereof. At a front surface of the main body casing 210, a tape outlet 212 is disposed. The tape outlet 212 is configured in the same manner as the tape outlet (see FIG. 1). Although the following features are not shown in FIG. 18 or 19, the tape attachment section 20 (see FIG. 3) is disposed at a middle portion of an upper surface of the main body casing 210. At a front left portion of the upper surface of the main body casing 210, an open button 214 for opening the cover 220 is disposed.

The cover 220 is disposed above the main body casing 210. The cover 220 is configured to rotate via a hinge (not shown) disposed at an upper rear end portion of the main body casing 210, above the main body casing 210. When closed relative to the main body casing 210, the cover 220 covers all of the upper surface of the main body casing 210 but the open button 214 (see FIG. 18). When the open button 214 is pressed in a state where the cover 220 is closed relative to the main body casing 210, the cover 220 is rotated toward an upper rear side around the hinge (not shown) by an urging force from a spring (not shown). Thereby, the cover 220 is opened relative to the main body casing 210, and the tape attachment section 20 (not shown) is exposed upward (see FIG. 19). Thus, the user is allowed to detachably attach the tape cassette 80 to the tape attachment section 20.

As shown in FIG. 19, the main body casing 210 is provided with a control board 19 (see FIG. 4). specifically, the control board 19 is disposed on a rear surface of the main body casing 210. Further, the main body casing 210 includes the print unit 240, the cut unit 250, and the battery 260. The print unit 240 is configured to perform a printing operation on the tape 8. The print unit 240 is provided integrally with elements shown in FIGS. 3 and 4 such as the print head 51, the platen holder 52, the platen roller 53, the movable conveyance roller 54, the tape driving shaft 55, the ribbon winding shaft 56, and the drive circuits 71 and 72. The cut unit 250 is configured to cut the tape 8. The cut unit 250 is provided integrally with elements shown in FIGS. 3 and 4 such as the cutter 57, the drive circuit 73, and the cut motor 89. The battery 260 is a built-in buttery configured to supply electricity to the printer 2.

An interface unit 230 is detachably attached to an upper surface 220A of the cover 220. The interface unit 230 includes a lower case 231 and an upper case 233. The lower case 231 includes a known touch panel display 232. The upper case 233 includes a known liquid crystal display (hereinafter referred to as an "LCD") 234. The upper case 233 is smaller in size than the lower case 231. The upper case 233 is configured to rotate via a hinge (not shown) disposed at an upper rear end portion of the lower case 231, above the lower case 231.

The user attaches the interface unit 230 to the upper surface 220A in the state where the cover 220 is closed relative to the main body casing 210. Thereby, the lower case 231 covers all of the upper surface 220A but a front end portion of the upper surface 220A. The touch panel display 232 is disposed in such a position that the user is allowed to operate and view the touch panel display 232 from above. Further, when the lower case 231 is opened relative to the upper case 233, the user is allowed to view the LCD 234 from the front. Thereby, for instance, the user is allowed to edit a label image by operating the touch panel display 232 while viewing a screen displayed on the LCD 234.

As shown in FIG. 19, the user is allowed to press the open button 214 in a state where the cover 220 is closed relative to the main body casing 210 and where the interface unit 230 is attached to the upper surface 220A. When the open button 214 is pressed in this state, the cover 220 is opened relative to the main body casing 210, with the interface unit 230 attached to the upper surface 220A of the cover 220. At this time, owing to the weight of the interface unit 230, a relatively large reaction is caused when the cover 220 is opened relative to the main body casing 210. By the reaction, the printer 2 might fall rearward. In order to prevent the fall, the print unit 240, the cut unit 250, and the buttery 260 are disposed in the following fashion inside the main body casing 210.

The print unit 240 is disposed under the tape attachment section 20 (not shown) inside the main body casing 210. The cut unit 250 is disposed between the tape outlet 212 and the print unit 240 inside the main body casing 210. Further, the cut unit 250 extends up to a position lower than the tape outlet 212 and the print unit 240. The battery 260 is disposed at a lower front portion inside the main body casing 210. Further, the battery 260 is positioned below the cut unit 250. Namely, the cut unit 250 and the battery 260, which have heavy weights, are disposed such that great loads are applied to a lower side of the main body casing 210, in a front portion of the main body casing 210. Thereby, even when the cover 220 with the interface unit 230 attached thereto is opened, it is possible to prevent the printer 2 from falling rearward.

What is claimed is:

1. A printer comprising:

a conveyor configured to convey a print medium in a conveyance direction along a conveyance path;

a print head configured to sequentially print a plurality of page images on the print medium at a first position on the conveyance path, each page image being an image representing a single unit of a page;

a cutter configured to cut the print medium at a second position on the conveyance path, the second position being downstream of the first position in the conveyance direction;

a first storage configured to store a plurality of pieces of print data for printing each individual page image in a manner separated for each print unit, each piece of print data expressing print contents of a single print unit;

a second storage configured to store cut target positions of the print medium to be cut by the cutter; and a controller configured to execute:

a printing process comprising:

controlling the print head to sequentially print the plurality of page images on the print medium based on the print data stored in the first storage while controlling the conveyor to convey the print medium;

a cut setting process comprising:

storing into the second storage a cut target position for each page image printed on the print medium;

a first interruption process comprising:

when a first distance is equal to or less than a second distance during the execution of the printing process, interrupting the printing process and stopping the print medium in a state where a next cut position coincides with the second position in the conveyance direction, wherein the next cut position is a cut target position that is located upstream of the second position in the conveyance direction and is closest to the second position among the cut target positions stored in the second storage, the first distance is a distance between the next cut position and the second position in the conveyance direction, the second distance is a distance of a printable range in the conveyance direction, and the printable range is a range in which an image is printed with a count of print units corresponding to an amount of the print data stored in the first storage; and controlling the cutter to cut the print medium;

a second interruption process comprising:

when the first distance is more than the second distance during the execution of the printing process, interrupting the printing process before a printing operation based on the print data stored in the first storage is completed, and stopping the print medium in a state where the next cut position coincides in the conveyance direction with a particular position that is located a distance equal to or more than a particular distance upstream of the second position; and a resuming process comprising:

resuming the printing process after one of the first interruption process and the second interruption process has been executed.

2. The printer according to claim 1, wherein the controller is further configured to execute a determining process comprising:

each time the print medium is conveyed over a predetermined reference distance during the execution of the printing process, determining whether a first condition or a second condition is satisfied, the first condition including a requirement that the first distance is less than a sum of the reference distance and a stop distance and a requirement that the second distance is equal to or more than a sum of the reference distance and the particular distance, the second condition including a requirement that the first distance is equal to or more than the sum of the reference distance and the stop distance and a requirement that the second distance is less than the sum of the reference distance and the particular distance, the stop distance being a distance over which the print medium is conveyed while a conveyance speed of the print medium is decelerated from a particular speed to zero, wherein the first interruption further comprises:

when it is determined that the first condition is satisfied in the determining process, controlling the conveyor to decelerate the conveyance speed of the print medium from the particular speed to zero and stop the print medium in the state where the next cut position coincides with the second position in the conveyance direction, and wherein the second interruption further comprises:

when it is determined that the second condition is satisfied in the determining process, controlling the conveyor to decelerate the conveyance speed from the particular speed to zero and stop the print medium in the state where the next cut position coincides with the particular position in the conveyance direction.

3. The printer according to claim 2, wherein the second interruption process further comprises:

controlling the conveyor to start decelerating the conveyance speed at a point of time when it is determined that the second condition is satisfied in the determining process.

4. The printer according to claim 2, wherein the print unit is a print line including a plurality of dots arranged in a direction perpendicular to the conveyance direction, and wherein the second interruption process further comprises:

when it is determined that the second condition is satisfied in the determining process, controlling the conveyor to stop the print medium in a state where the first position coincides with a smallest-dot-amount print position in the conveyance direction, the smallest-dot-amount print position being a position of a print line having a smallest number of dots within the printable range.

5. The printer according to claim 2, wherein the second interruption process comprises:

when it is determined that the second condition is satisfied in the determining process, controlling the conveyor to stop the print medium in a state where the first position coincides with a limit stop position in the conveyance direction, the limit stop position being an upstream end position of a stoppable range included in the printable range in the conveyance direction, and wherein the stoppable range is a range between:

a shortest stop position that is located the stop distance upstream of the first position in the conveyance direction; and a longest stop position that is located a specific distance upstream of the first position in the conveyance direction, the specific distance being obtained by subtracting the particular distance from the first distance.

6. The printer according to claim 2, wherein the determining process further comprises:

determining whether a third condition is satisfied, the third condition including the requirement that the first distance is equal to or more than the sum of the reference distance and the stop distance and the requirement that the second distance is equal to or more than the sum of the reference distance and the particular distance, and wherein the controller is further configured to, when determining that the third condition is satisfied in the determining process, continue the printing process without interrupting the printing process.

7. The printer according to claim 1, wherein the particular distance is a lower limit of a particular conveyance distance that enables to ensure an acceptable quality level of an image to be printed while the print medium is conveyed over the particular conveyance distance from start to stop of the conveyance of the print medium.

8. The printer according to claim 1, wherein the controller comprises:

a processor; and a memory storing processor-executable instructions configured to, when executed by the processor, cause the processor to execute the printing process, the cut setting process, the first interruption process, the second interruption process, and the resuming process.

9. A method adapted to be implemented on a processor coupled with a printer comprising:

a conveyor configured to convey a print medium in a conveyance direction along a conveyance path;

a print head configured to sequentially print a plurality of page images on the print medium at a first position on the conveyance path, each page image being an image representing a single unit of a page;

a cutter configured to cut the print medium at a second position on the conveyance path, the second position being downstream of the first position in the conveyance direction;

a first storage configured to store a plurality of pieces of print data for printing each individual page image in a manner separated for each print unit, each piece of print data expressing print contents of a single print unit; and a second storage configured to store cut target positions of the print medium to be cut by the cutter, the method comprising:

a printing process comprising:

controlling the print head to sequentially print the plurality of page images on the print medium based on the print data stored in the first storage while controlling the conveyor to convey the print medium;

a cut setting process comprising:

storing into the second storage a cut target position for each page image printed on the print medium;

a first interruption process comprising:

when a first distance is equal to or less than a second distance during the printing process, interrupting the printing process and stopping the print medium in a state where a next cut position coincides with the second position in the conveyance direction, wherein the next cut position is a cut target position that is located upstream of the second position in the conveyance direction and is closest to the second position among the cut target positions stored in the second storage, the first distance is a distance between the next cut position and the second position in the conveyance direction, the second distance is a distance of a printable range in the conveyance direction, and the printable range is a range in which an image is printed with a count of print units corresponding to an amount of the print data stored in the first storage; and controlling the cutter to cut the print medium;

a second interruption process comprising:

when the first distance is more than the second distance during the printing process, interrupting the printing process before a printing operation based on the print data stored in the first storage is completed, and stopping the print medium in a state where the next cut position coincides in the conveyance direction with a particular position that is located a distance equal to or more than a particular distance upstream of the second position; and a resuming process comprising:

resuming the printing process after one of the first interruption process and the second interruption process has been executed.

10. The method according to claim 9, further comprising a determining process that comprises:

each time the print medium is conveyed over a predetermined reference distance during the execution of the printing process, determining whether a first condition or a second condition is satisfied, the first condition including a requirement that the first distance is less than a sum of the reference distance and a stop distance and a requirement that the second distance is equal to or more than a sum of the reference distance and the particular distance, the second condition including a requirement that the first distance is equal to or more than the sum of the reference distance and the stop distance and a requirement that the second distance is less than the sum of the reference distance and the particular distance, the stop distance being a distance over which the print medium is conveyed while a conveyance speed of the print medium is decelerated from a particular speed to zero, wherein the first interruption further comprises:

when it is determined that the first condition is satisfied in the determining process, controlling the conveyor to decelerate the conveyance speed of the print medium from the particular speed to zero and stop the print medium in the state where the next cut position coincides with the second position in the conveyance direction, and wherein the second interruption further comprises:

when it is determined that the second condition is satisfied in the determining process, controlling the conveyor to decelerate the conveyance speed from the particular speed to zero and stop the print medium in the state where the next cut position coincides with the particular position in the conveyance direction.

11. The method according to claim 10, wherein the second interruption process further comprises:

controlling the conveyor to start decelerating the conveyance speed at a point of time when it is determined that the second condition is satisfied in the determining process.

12. The method according to claim 10, wherein the print unit is a print line including a plurality of dots arranged in a direction perpendicular to the conveyance direction, and wherein the second interruption process further comprises:

when it is determined that the second condition is satisfied in the determining process, controlling the conveyor to stop the print medium in a state where the first position coincides with a smallest-dot-amount print position in the conveyance direction, the smallest-dot-amount print position being a position of a print line having a smallest number of dots within the printable range.

13. The method according to claim 10, wherein the second interruption process comprises:

when it is determined that the second condition is satisfied in the determining process, controlling the conveyor to stop the print medium in a state where the first position coincides with a limit stop position in the conveyance direction, the limit stop position being an upstream end position of a stoppable range included in the printable range in the conveyance direction, and wherein the stoppable range is a range between:

a shortest stop position that is located the stop distance upstream of the first position in the conveyance direction; and a longest stop position that is located a specific distance upstream of the first position in the conveyance direction, the specific distance being obtained by subtracting the particular distance from the first distance.

14. The method according to claim 10, wherein the determining process further comprises:

determining whether a third condition is satisfied, the third condition including the requirement that the first distance is equal to or more than the sum of the reference distance and the stop distance and the requirement that the second distance is equal to or more than the sum of the reference distance and the particular distance, and wherein the method further comprises continuing the printing process without interrupting the printing process when it is determined that the third condition is satisfied in the determining process.

15. A non-transitory computer-readable medium storing computer-readable instructions that are executable by a processor coupled with a printer comprising:

a conveyor configured to convey a print medium in a conveyance direction along a conveyance path;

a print head configured to sequentially print a plurality of page images on the print medium at a first position on the conveyance path, each page image being an image representing a single unit of a page;

a cutter configured to cut the print medium at a second position on the conveyance path, the second position being downstream of the first position in the conveyance direction;

a first storage configured to store a plurality of pieces of print data for printing each individual page image in a manner separated for each print unit, each piece of print data expressing print contents of a single print unit; and a second storage configured to store cut target positions of the print medium to be cut by the cutter, the instructions being configured to, when executed by the processor, cause the processor to execute:

a printing process comprising:

controlling the print head to sequentially print the plurality of page images on the print medium based on the print data stored in the first storage while controlling the conveyor to convey the print medium;

a cut setting process comprising:

storing into the second storage a cut target position for each page image printed on the print medium;

a first interruption process comprising:

when a first distance is equal to or less than a second distance during the execution of the printing process, interrupting the printing process and stopping the print medium in a state where a next cut position coincides with the second position in the conveyance direction, wherein the next cut position is a cut target position that is located upstream of the second position in the conveyance direction and is closest to the second position among the cut target positions stored in the second storage, the first distance is a distance between the next cut position and the second position in the conveyance direction, the second distance is a distance of a printable range in the conveyance direction, and the printable range is a range in which an image is printed with a count of print units corresponding to an amount of the print data stored in the first storage; and controlling the cutter to cut the print medium;

a second interruption process comprising:

when the first distance is more than the second distance during the execution of the printing process, interrupting the printing process before a printing operation based on the print data stored in the first storage is completed, and stopping the print medium in a state where the next cut position coincides in the conveyance direction with a particular position that is located a distance equal to or more than a particular distance upstream of the second position; and a resuming process comprising:

resuming the printing process after one of the first interruption process and the second interruption process has been executed.

16. The non-transitory computer-readable medium according to claim 15, wherein the instructions are further configured to, when executed by the processor, cause the processor to execute a determining process comprising:

each time the print medium is conveyed over a predetermined reference distance during the execution of the printing process, determining whether a first condition or a second condition is satisfied, the first condition including a requirement that the first distance is less than a sum of the reference distance and a stop distance and a requirement that the second distance is equal to or more than a sum of the reference distance and the particular distance, the second condition including a requirement that the first distance is equal to or more than the sum of the reference distance and the stop distance and a requirement that the second distance is less than the sum of the reference distance and the particular distance, the stop distance being a distance over which the print medium is conveyed while a conveyance speed of the print medium is decelerated from a particular speed to zero, wherein the first interruption further comprises:

when it is determined that the first condition is satisfied in the determining process, controlling the conveyor to decelerate the conveyance speed of the print medium from the particular speed to zero and stop the print medium in the state where the next cut position coincides with the second position in the conveyance direction, and wherein the second interruption further comprises:

when it is determined that the second condition is satisfied in the determining process, controlling the conveyor to decelerate the conveyance speed from the particular speed to zero and stop the print medium in the state where the next cut position coincides with the particular position in the conveyance direction.

17. The non-transitory computer-readable medium according to claim 16, wherein the second interruption process further comprises:

controlling the conveyor to start decelerating the conveyance speed at a point of time when it is determined that the second condition is satisfied in the determining process.

18. The non-transitory computer-readable medium according to claim 16, wherein the print unit is a print line including a plurality of dots arranged in a direction perpendicular to the conveyance direction, and wherein the second interruption process further comprises:

when it is determined that the second condition is satisfied in the determining process, controlling the conveyor to stop the print medium in a state where the first position coincides with a smallest-dot-amount print position in the conveyance direction, the smallest-dot-amount print position being a position of a print line having a smallest number of dots within the printable range.

19. The non-transitory computer-readable medium according to claim 16, wherein the second interruption process comprises:

when it is determined that the second condition is satisfied in the determining process, controlling the conveyor to stop the print medium in a state where the first position coincides with a limit stop position in the conveyance direction, the limit stop position being an upstream end position of a stoppable range included in the printable range in the conveyance direction, and wherein the stoppable range is a range between:

a shortest stop position that is located the stop distance upstream of the first position in the conveyance direction; and a longest stop position that is located a specific distance upstream of the first position in the conveyance direction, the specific distance being obtained by subtracting the particular distance from the first distance.

20. The non-transitory computer-readable medium according to claim 16, wherein the determining process further comprises:

determining whether a third condition is satisfied, the third condition including the requirement that the first distance is equal to or more than the sum of the reference distance and the stop distance and the requirement that the second distance is equal to or more than the sum of the reference distance and the particular distance, and wherein the instructions are further configured to, when executed by the processor, cause the processor to continue the printing process without interrupting the printing process when it is determined that the third condition is satisfied in the determining process.

* * * * *